US007708322B2

(12) United States Patent
Timothy et al.

(10) Patent No.: US 7,708,322 B2
(45) Date of Patent: May 4, 2010

(54) ACTUATOR FOR USE IN FENESTRATION SYSTEMS

(75) Inventors: E. Erik Timothy, Apollo Beach, FL (US); Peter Minter, East Haven, CT (US)

(73) Assignee: Caldwell Manufacturing Company, Rochester, NY (US)

( * ) Notice: Subject to any disclaimer, the term of this patent is extended or adjusted under 35 U.S.C. 154(b) by 1074 days.

(21) Appl. No.: 10/980,204

(22) Filed: Nov. 3, 2004

(65) Prior Publication Data

US 2007/0052247 A1 Mar. 8, 2007

Related U.S. Application Data

(63) Continuation-in-part of application No. 10/154,246, filed on May 23, 2002, now Pat. No. 7,004,515.

(60) Provisional application No. 60/294,533, filed on May 30, 2001.

(51) Int. Cl.
*E05C 1/02* (2006.01)
*E05C 1/00* (2006.01)

(52) U.S. Cl. ..... 292/137; 292/36; 292/38; 292/336.3; 292/DIG. 20; 292/DIG. 47; 49/394

(58) Field of Classification Search ..... 292/137, 292/336.3, DIG. 27; 16/412, 413; 49/394
See application file for complete search history.

(56) References Cited

U.S. PATENT DOCUMENTS

| | | | | |
|---|---|---|---|---|
| 1,866,684 | A | 7/1932 | Van Der Leun | |
| 2,548,578 | A | 4/1951 | Andersson et al. | 292/141 |
| 4,199,176 | A | 4/1980 | Kelly | |
| 4,602,457 | A | 7/1986 | Kreusel | 49/192 |
| 4,739,583 | A | 4/1988 | Tonsmann et al. | 49/192 |
| 4,807,914 | A | 2/1989 | Fleming et al. | 292/48 |
| 4,887,392 | A | 12/1989 | Lense | 49/300 |
| 4,937,976 | A | 7/1990 | Tucker et al. | 49/345 |
| 5,118,145 | A * | 6/1992 | Tucker | 292/158 |
| 5,152,103 | A | 10/1992 | Tucker et al. | 49/279 |
| 5,318,333 | A * | 6/1994 | Dreifert | 292/336.3 |
| 5,329,869 | A | 7/1994 | Freeman et al. | 114/117 |
| 5,370,428 | A | 12/1994 | Driefert et al. | 292/161 |
| 5,492,377 | A * | 2/1996 | Guelck | 292/2 |
| 5,533,798 | A | 7/1996 | Feldpausch et al. | 312/219 |
| 5,741,031 | A * | 4/1998 | Bauman et al. | 292/139 |

(Continued)

*Primary Examiner*—Carlos Lugo
(74) *Attorney, Agent, or Firm*—Brown & Michaels, PC

(57) ABSTRACT

An actuator for use in fenestration systems having a swinging sash or door is characterized by the use of a linear member running continuously from an actuating assembly to a locking pin assembly. The linear member can be a flexible linear member, allowing it to convey motion to the locking pin assembly around corners. The locking pin assembly has a moveable locking pin with an actuator and an extension that can engage a keeper. The linear member has multiple actuator engagement sites along its length where the actuator of the locking pin can engage the linear member. The linear member can then be used to move the locking pin with respect to the locking pin assembly so that the extension can engage or disengage a keeper. The locking pin assembly can be mounted on a fenestration frame and the keeper opposingly mounted on a window or door mounted in the fenestration frame. Alternately, the keeper can be incorporated into the fenestration frame and the locking pin assembly opposingly mounted on the window or door mounted in the fenestration frame.

17 Claims, 23 Drawing Sheets

U.S. PATENT DOCUMENTS

| | | | | |
|---|---|---|---|---|
| 5,927,767 | A | 7/1999 | Smith et al. | 292/158 |
| 5,992,907 | A | 11/1999 | Sheldon et al. | 292/34 |
| 6,135,511 | A | 10/2000 | Smith et al. | 292/156 |
| 6,450,554 | B1 * | 9/2002 | Rotondi et al. | 292/158 |
| 6,523,868 | B1 | 2/2003 | Timothy | 292/241 |
| 6,565,133 | B1 | 5/2003 | Timothy | 292/242 |
| 6,651,389 | B2 * | 11/2003 | Minter et al. | 49/394 |
| 7,004,515 | B2 * | 2/2006 | Timothy | 292/137 |
| 7,219,469 | B2 * | 5/2007 | DiFrancesco | 49/395 |

* cited by examiner

FIG. 4A
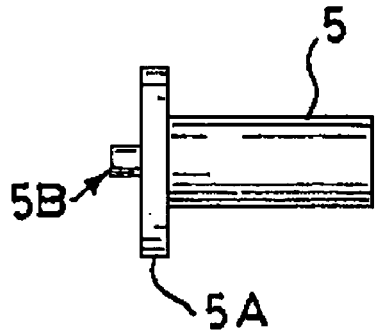
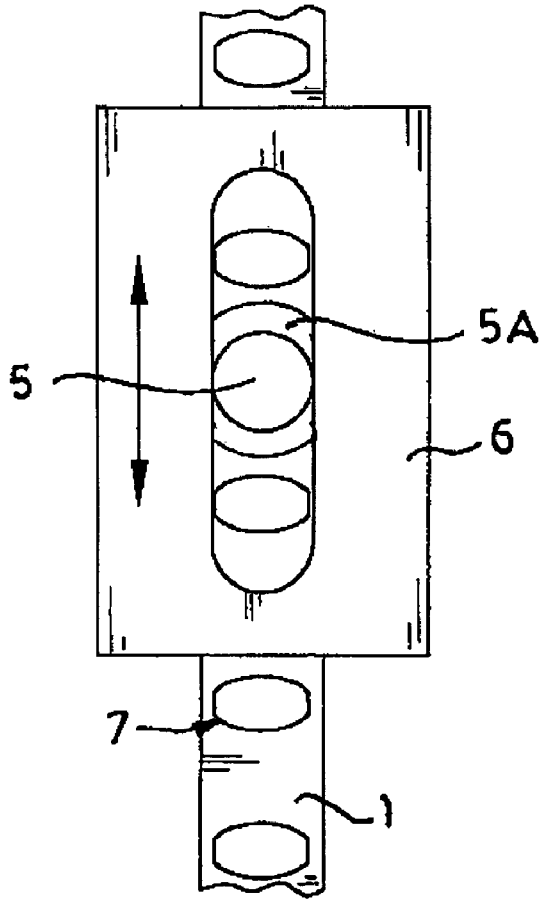
FIG. 4B

FIG.11A
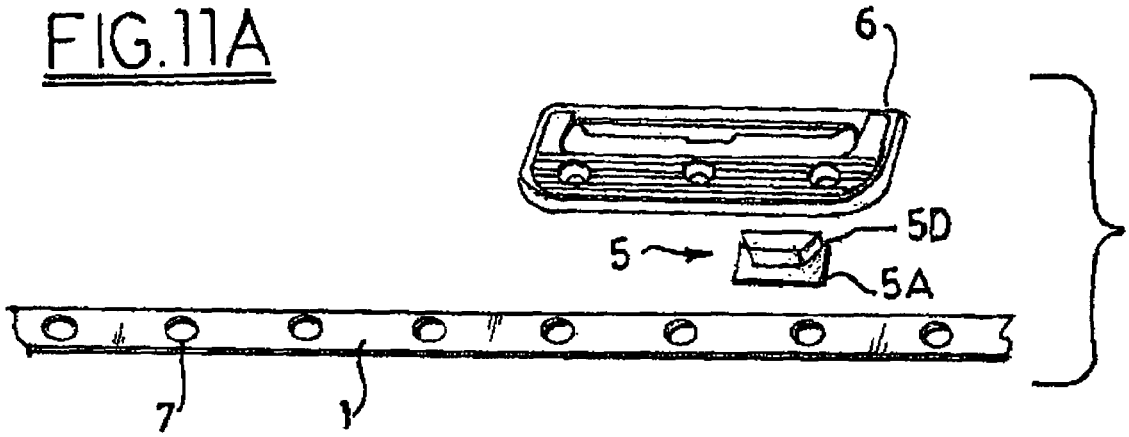
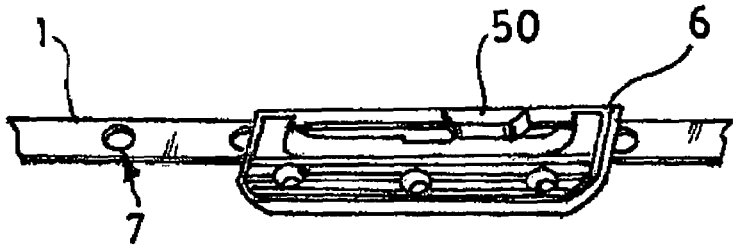
FIG.11B

FIG. 12A
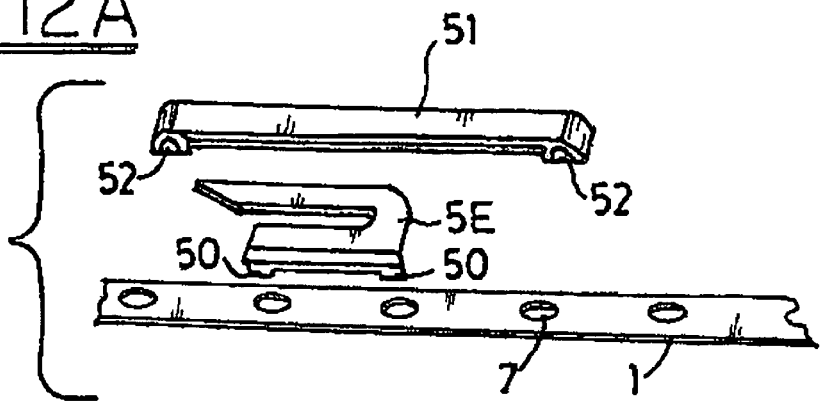
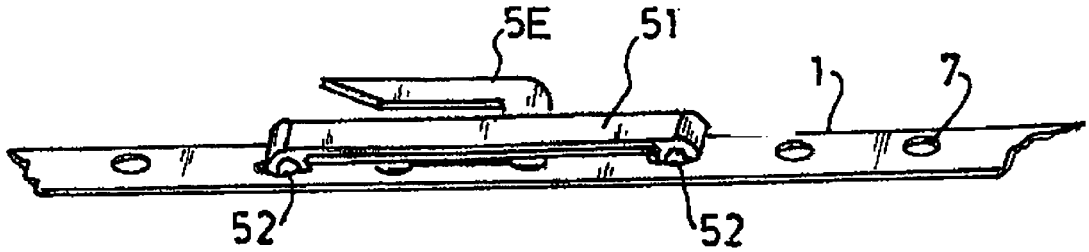
FIG. 12B

ACTUATOR FOR USE IN FENESTRATION SYSTEMS

RELATED APPLICATIONS

This application is a Continuation-In-Part of copending parent application Ser. No. 10/154,246, filed 23 May 2002, entitled FENESTRATION LOCKING SYSTEM, which parent application claims the benefit of U.S. Provisional Application No. 60/294,533, filed on 30 May 2001. Both the parent application and the Provisional application are hereby incorporated by reference.

TECHNICAL FIELD

This invention deals generally with actuators for use in fenestration systems for openings having a swinging closure means such as a swinging sash, door, or gate. More specifically, it pertains to locking systems that use sliding elements to transfer locking motion, especially those using bendable sliding elements to transfer locking motion around a corner. It emphasizes systems using a flexible push-pull member and actuating lever handle arrangements suitable for use with such systems.

BACKGROUND OF THE INVENTION

Fenestration is generally considered to include any opening in a building's envelope, including windows, doors, and skylights. The technology applicable in the fenestration context can, however, also be applicable for other enclosure openings, such as gates in walls or fences.

There are many fenestration locking systems currently in existence. Only a few of these systems use a bendable sliding element to transfer locking motion around a corner. Among systems using a bendable sliding element are sash locking systems that have a flexible cable that extends all the way around the window. In these systems, a locking element can be pulled in two directions by opposing cables for locking and unlocking purposes. However, the cables are only used in a pulling mode; they cannot be used in a pushing mode. More typical are sash locking systems that feature a flexible push-pull member at the corner of the window frame. This push-pull member serves as a bendable sliding element and can be pulled or pushed to lock or unlock a window sash. In these systems, the flexible push-pull member is generally connected to a rigid vertical locking bar carrying the locking pins for the sash. Sash locking systems also use a variety of lever handle arrangements for moving these bendable sliding elements back and forth so as to engage or disengage a sash lock.

U.S. Pat. No. 4,887,392, issued to Lense in 1989 for an "Apparatus for Actuating and Locking a Window Sash", provides an example of a design using a flexible push-pull member at a window corner. This patent uses a flexible tape that drives around the corner; but once the tape rounds the corner; it connects to a rigid locking bar that moves up and down to accomplish sash locking. The tape is also moved by an actuator that opens and closes the window, rather than by a separate lever.

Contrasting but related designs can be seen in U.S. Pat. Nos. 4,807,914 and 5,370,428. U.S. Pat. No. 4,807,914, issued to Fleming et al. in 1989 for a "Window Lock Assembly", shows a locking system driven by a perforated tape. However, this tape does not extend around a corner. It merely serves as a rack driving a pinion formed as a locking cam. U.S. Pat. No. 5,370,428, issued to Dreifert et al. in 1994 for a "Mechanism for Releasably Locking Sashes in Door or Window Frames", shows sash locking pins driven by a moving lock bar to which the pins are not attached. The pins are trapped for movement within guides that straddle or cover both sides of the locking bar.

Of the systems described above, those using a flexible member to form a bendable corner push-pull sliding element have proven to be simpler to construct and less expensive. However, there remains a need for improvements that will create a locking system that is similar in function, but even simpler to manufacture and operate than prior art devices. These improvements should also serve to create a single lever locking system that is more versatile and significantly less expensive to construct and install.

SUMMARY OF THE INVENTION

Our first improvement is the use of a uniformly flexible push-pull member that can be used not only to transfer movement around a fenestration corner, but to transfer movement all the way from a distant location on the fenestration edge to a locking member. Thus, our flexible push-pull member can be used to transfer movement from a locking lever at the bottom of a window around the corner and up the side of the frame (or "jamb") to the position of the upper-most locking pin. In addition, the location of the operative parts of our invention can be reversed. For example, the flexible push-pull member and related parts can be mounted on the door or sash with keepers mounted on or incorporated into the doorframe or jamb. The actuating assembly can, likewise, be mounted either with the flexible push-pull member or opposed to it. Thus, for example, it can be mounted with the flexible push-pull member on a sash or opposed to it on a frame. Further, our invention, unlike prior art devices, is capable of use around irregularly shaped windows and doors. Thus, it can easily be adapted for use around a round window or window opening.

In our invention, locking pins are not directly attached to the flexible member. In some embodiments of our invention, the locking pins have collars or enlarged portions that trap the pins in place under slotted guides mounted on the edges of the fenestration or fenestration closure means. In other embodiments, the guide is a slotted cover strip that overlays the flexible member and locking pins. In either case, the locking pin is generally provided with a coaxial motion transmitting pin or member that extends into regularly spaced perforations in the flexible member. This eliminates any permanent connection between our locking pins and the flexible member and simplifies the installation of the pins and flexible member. It also allows the locking pins to be mounted to engage various perforations in the flexible member, depending on the dimensional requirements of the door, window, or opening in question. Finally, it can be used to easily increase the locking points for a given sized window. This makes the window more secure and also allows it to pass higher test standards.

We have also improved the actuating assembly used in our invention. It has a simple three-piece structure. In general, it features a lower piece with a slot that runs parallel with and above the flexible member (or "locking tape"), and an upper piece with a slot oriented transverse to the direction of movement of the locking tape. In this configuration, the locking lever has a drive pin that extends into the locking tape and a pivot pin that extends upward into the slot running transverse to the tape. However, our actuating assembly can also be constructed with both slots and both pins on the same side of the locking lever. In either configuration, as the lever is rotated, the pivot pin moves along the length of the transverse slot while the tape drive pin drives along the direction of movement of the tape. This, in effect, creates a lever arm that is rotatable about two axes of rotation, one provided by the drive pin and the other provided by the pivot arm. The arrangement provides a low mechanical advantage and higher speed movement as the locking motion is commenced, and a greatly increased mechanical advantage and slower speed movement as the locking pins are driven home to pull the sash or door snuggly into a sealed closure with its frame. The arrangement also aligns the two pins with the direction of movement of the tape. Thus, when the sash or door is locked, it is not possible to pry into the edge of the frame and push against the locking pins to move the tape to an unlocked position.

These improvements serve to create a fenestration locking system that is similar in function but simpler and more effective in installation and application than prior art devices. Indeed, all a user generally needs for implementing our invention in a window or door opening is (1) a strip of flexible member; (2) one or more of our pins; (3) pin guides; (4) a corner bracket for guiding the flexible member around sharp corners; (5) keepers for placement on frame, door, or sash; and (6) an actuating assembly. There is no further need for fixed length locking bars with pins mounted on the locking bars in addition to guide plates supporting such pins or locking bars. These improvements also serve to create a single lever locking system that is significantly less expensive. Indeed, our improved actuating assembly is so compact that the locking lever can fit directly below the operator that opens and closes a sash, putting all the controls neatly in a single location and avoiding any interference with window blinds and curtains. These and the numerous other advantages of our invention will become evident upon review of the drawings and detailed description that follow.

DESCRIPTION OF THE DRAWINGS

FIGS. 1-4B illustrate an embodiment of our invention where the locking pins are held in place by slotted guides mounted on the edges of a fenestration opening.

FIG. 1 provides a perspective view of an upper locking pin assembly for this embodiment of our invention.

FIG. 2 provides a first perspective view of a lower locking pin assembly, corner guide, and actuating assembly for this embodiment of our invention.

FIG. 3 provides a second perspective view of a lower locking pin assembly, corner guide, and actuating assembly for this embodiment of our invention.

FIG. 4A provides a side view of a locking pin for this embodiment of our invention.

FIG. 4B provides a frontal view of a locking pin assembly for this embodiment of our invention.

FIGS. 5A-6G illustrate features relevant to the structure, construction, and use of our locking lever.

FIG. 5A provides an exploded perspective view of an actuating assembly of our invention.

FIG. 6G provides a schematic cross-sectional view of the actuating assembly after it has been moved 120 degrees towards a closed position.

FIGS. 7A-7C illustrate an actuating assembly adapted for direct use with a sash keeper, while

FIG. 7A provides an exploded perspective view of an actuating assembly adapted for direct use with a sash keeper.

FIG. 7B provides a perspective view of the actuating assembly illustrated in FIG. 7A in an unlocked position.

FIG. 7C provides a perspective view of the actuating assembly illustrated in FIG. 7A in a locked position, engaging a sash keeper.

FIG. 7D provides a perspective view of an actuating assembly positioned between and interacting with two locking pin assemblies via a rigid lock bar.

FIGS. 8A-10B illustrate embodiments of our invention where the locking pins are held in place by slotted cover strips.

FIG. 8A provides a perspective view of one of these embodiments of our invention.

FIG. 8B provides a perspective view illustrating a variation of this embodiment of our invention.

FIG. 10B provides a cross-sectional view of a second embodiment of the cover strip of our invention.

FIGS. 11A-17D illustrate additional preferred embodiments and alternatives for several elements of our invention.

FIG. 11A provides an exploded perspective view of an alternative locking pin and guide.

FIG. 11B provides an assembled view of the alternative locking pin and guide illustrated in FIG. 11A.

FIG. 12A provides an exploded perspective view of another alternative having a hook-shaped locking member with its guide.

FIG. 12B provides an assembled view of the alternative hook-shaped locking member and guide illustrated in FIG. 12A.

FIG. 14 provides a perspective view of a first actuating assembly where both slots and both pins are located on the same side of the lever.

FIG. 15 provides an exploded perspective view of the configuration illustrated in FIG. 14.

FIG. 17D provides a more detailed perspective view of the actuating assembly of FIG. 17C.

DESCRIPTION OF THE INVENTION

Figure 1:
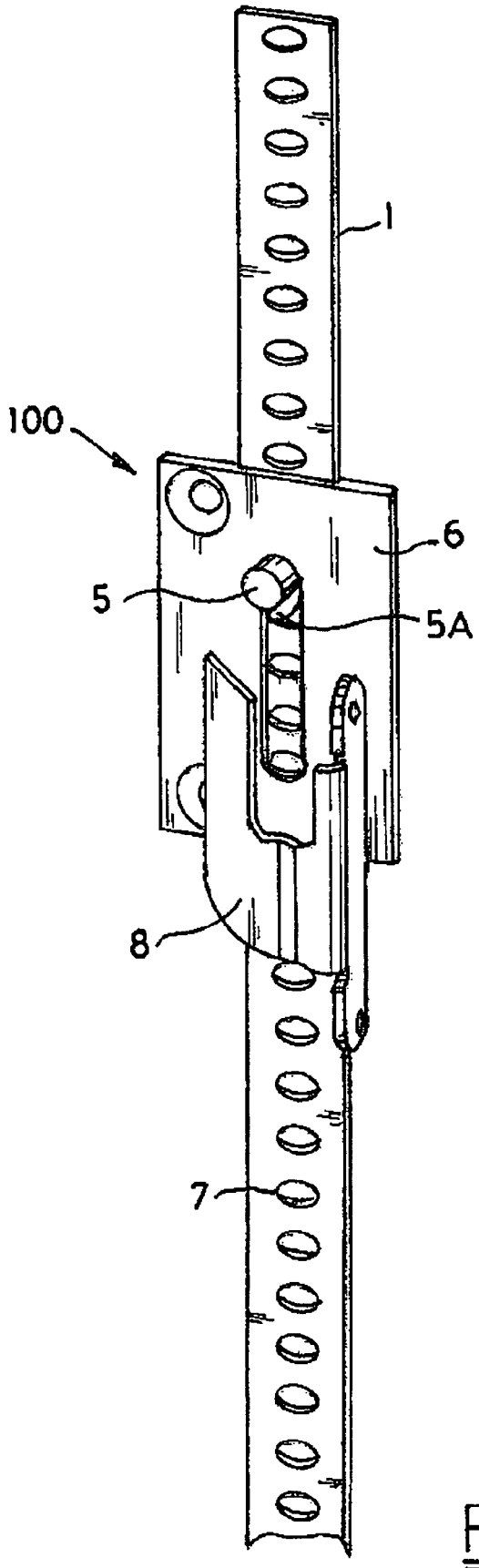
Figure 2:
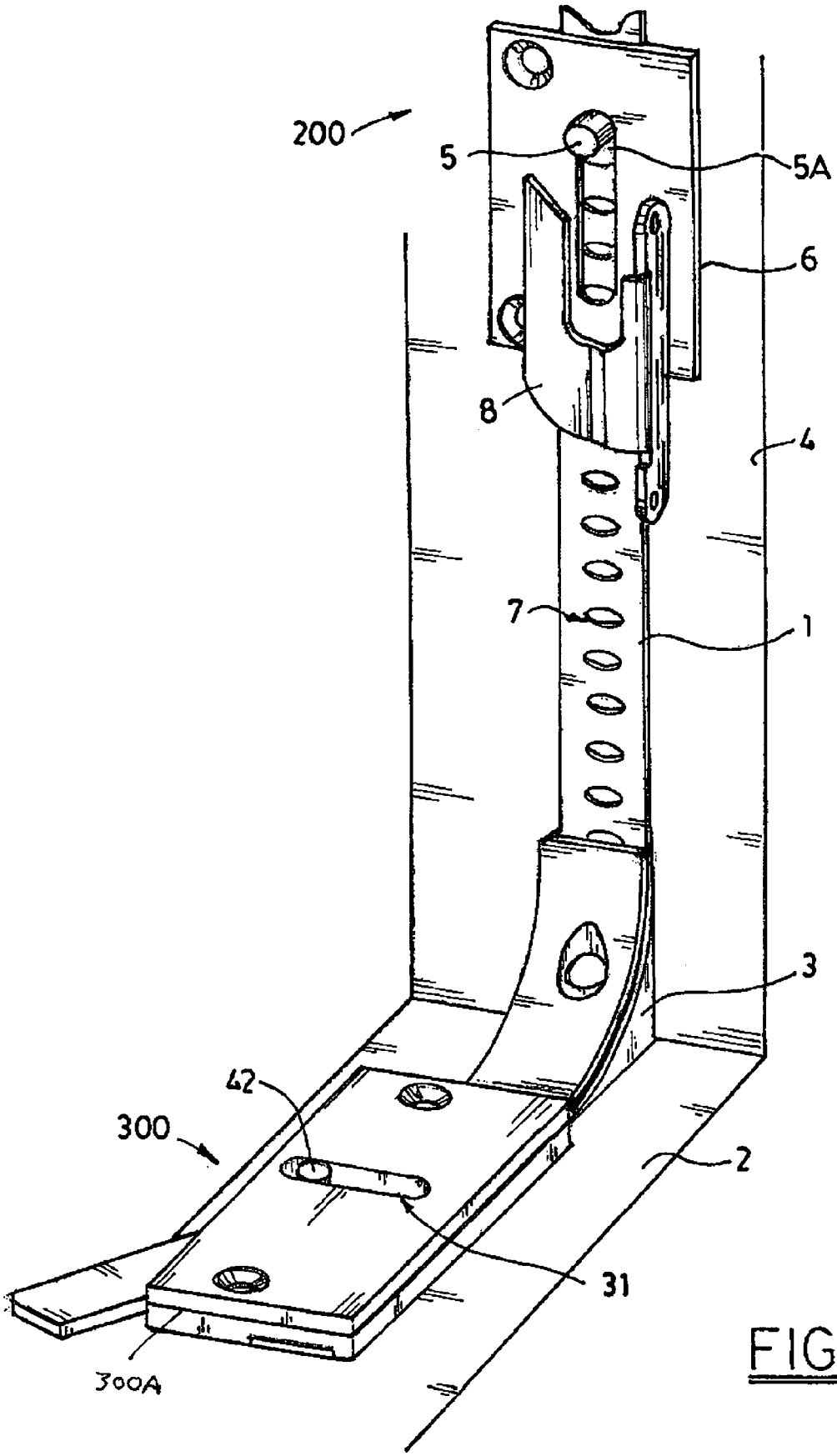
Figure 3:
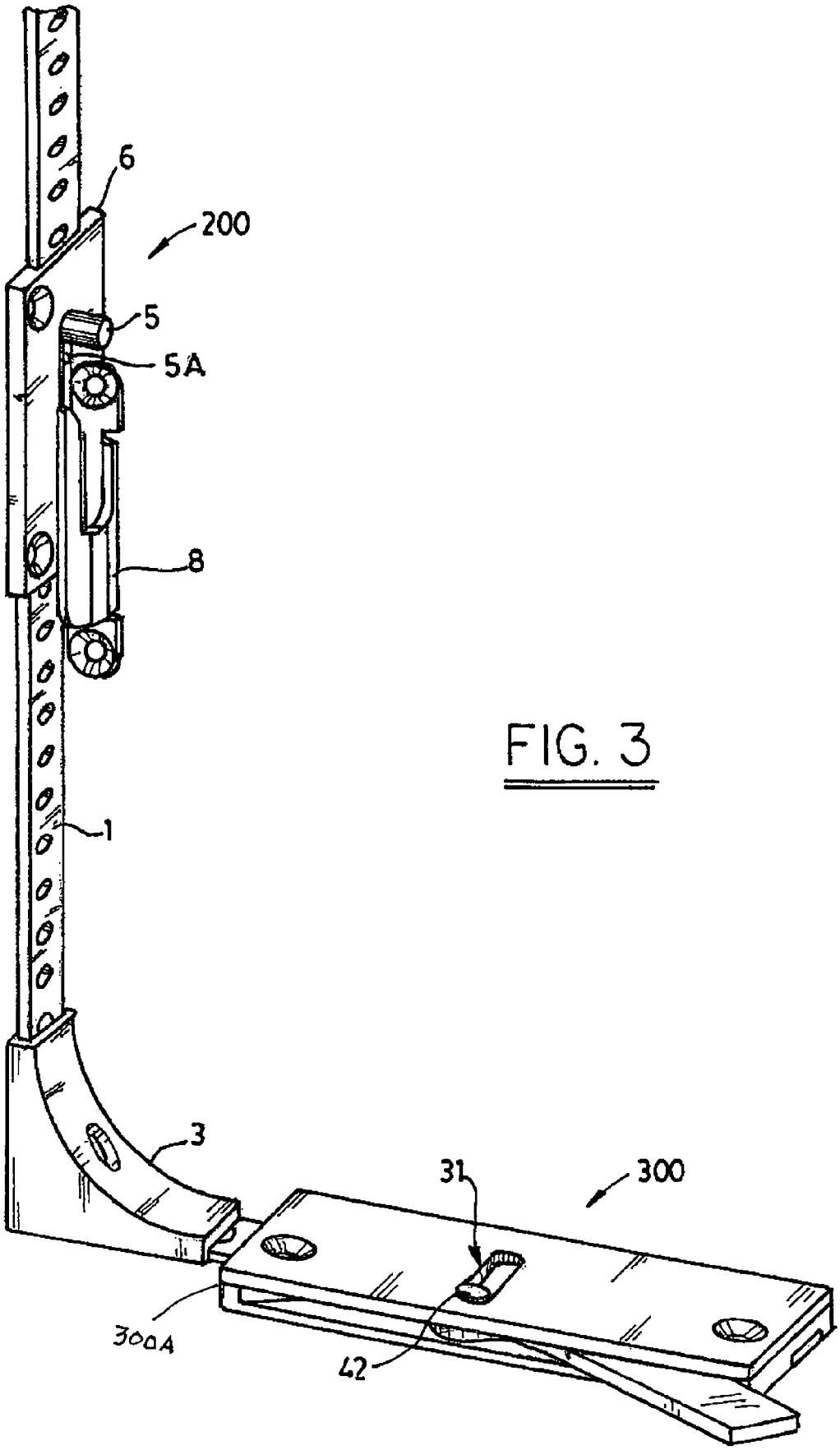
Figure 5A:
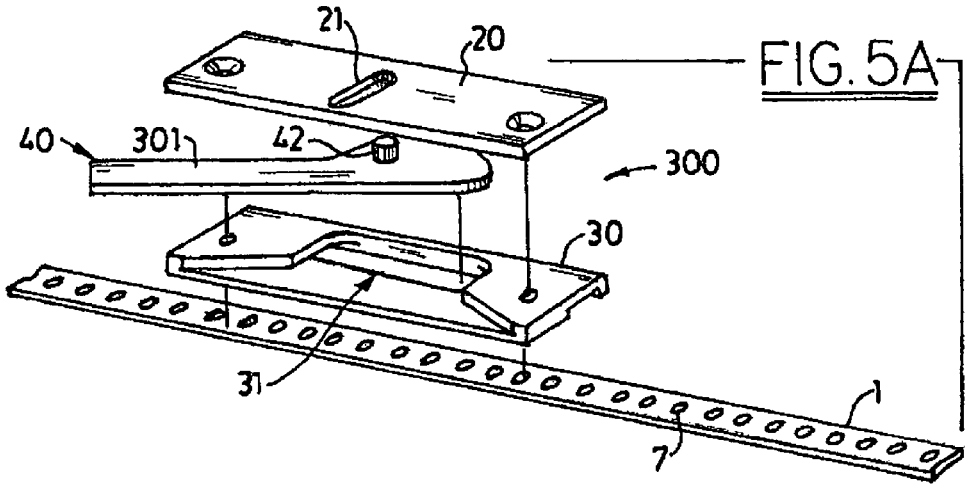
Figure 5B:
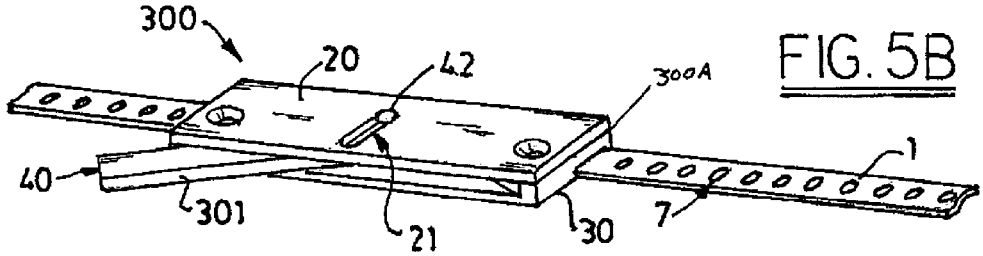
FIG. 5B provides a perspective view of an actuating assembly of our invention.
Figure 5C:
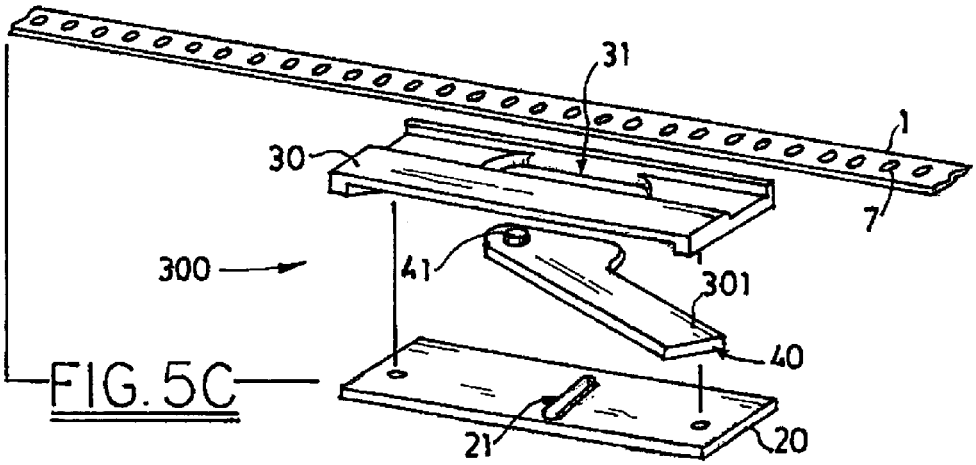
FIG. 5C provides an inverted exploded perspective view of an actuating assembly of our invention.
Figure 6A:
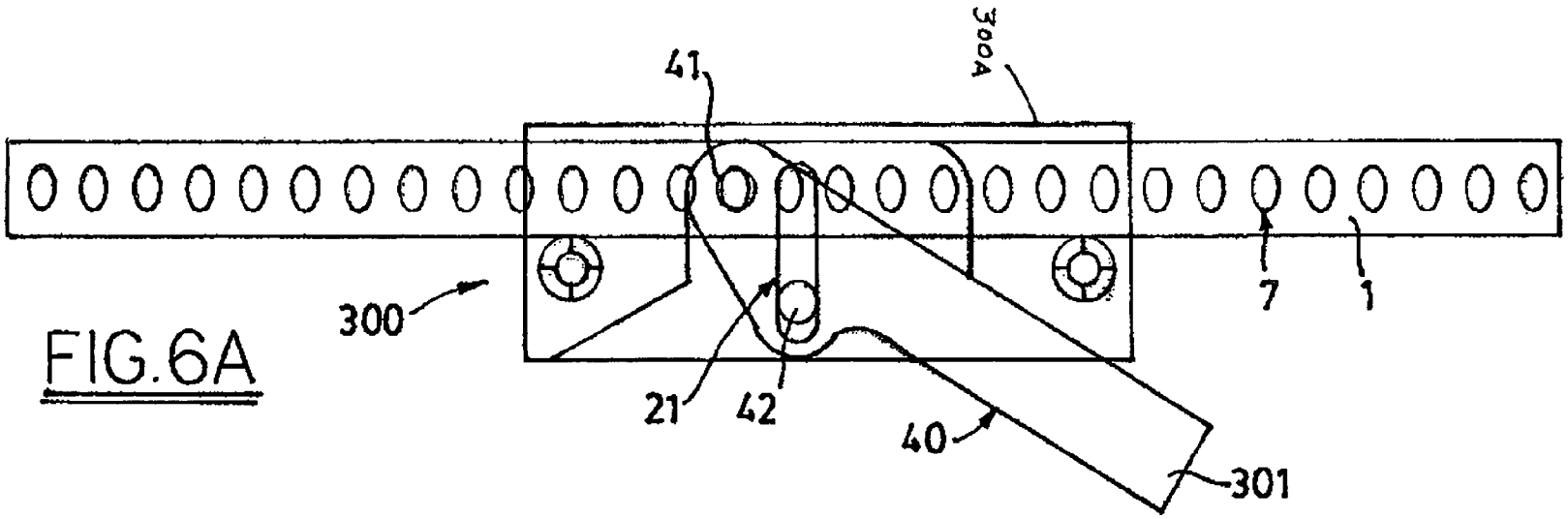
FIG. 6A provides a schematic cross-sectional view of the actuating assembly in an open position.
Figure 6B:
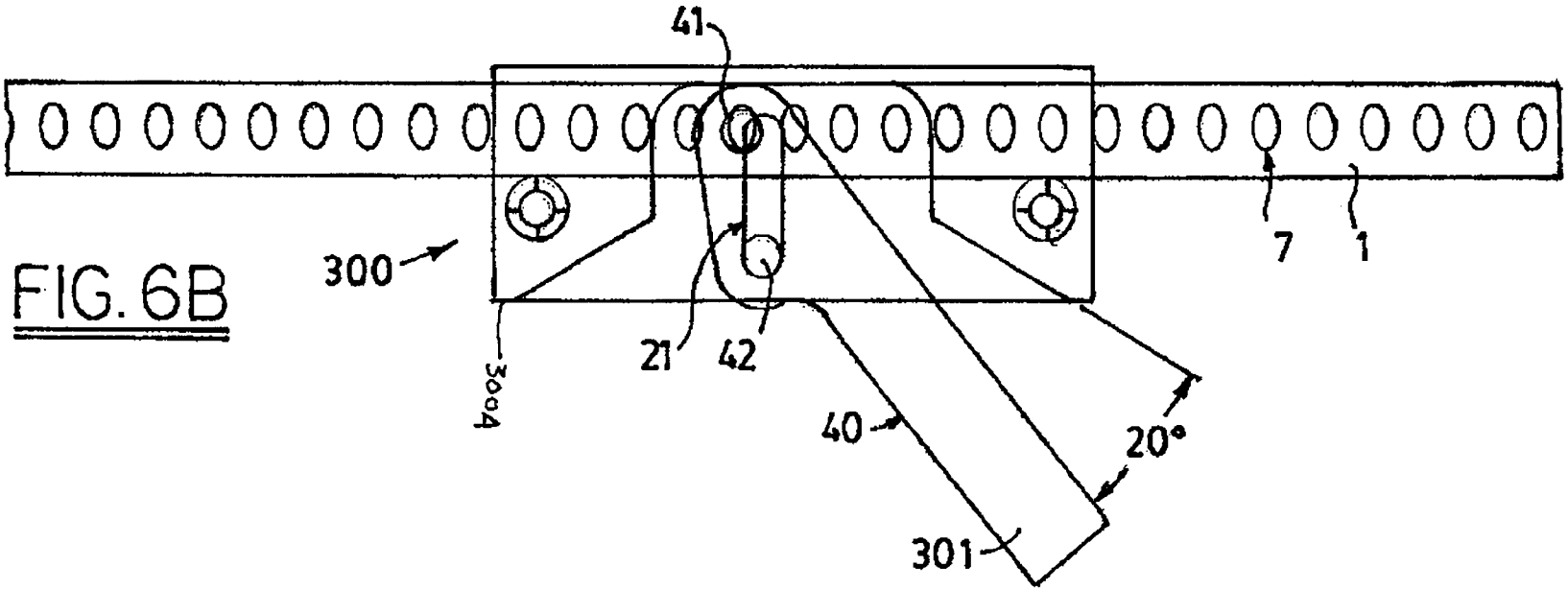
FIG. 6B provides a schematic cross-sectional view of the actuating assembly after it has been moved 20 degrees towards a closed position.
Figure 6C:
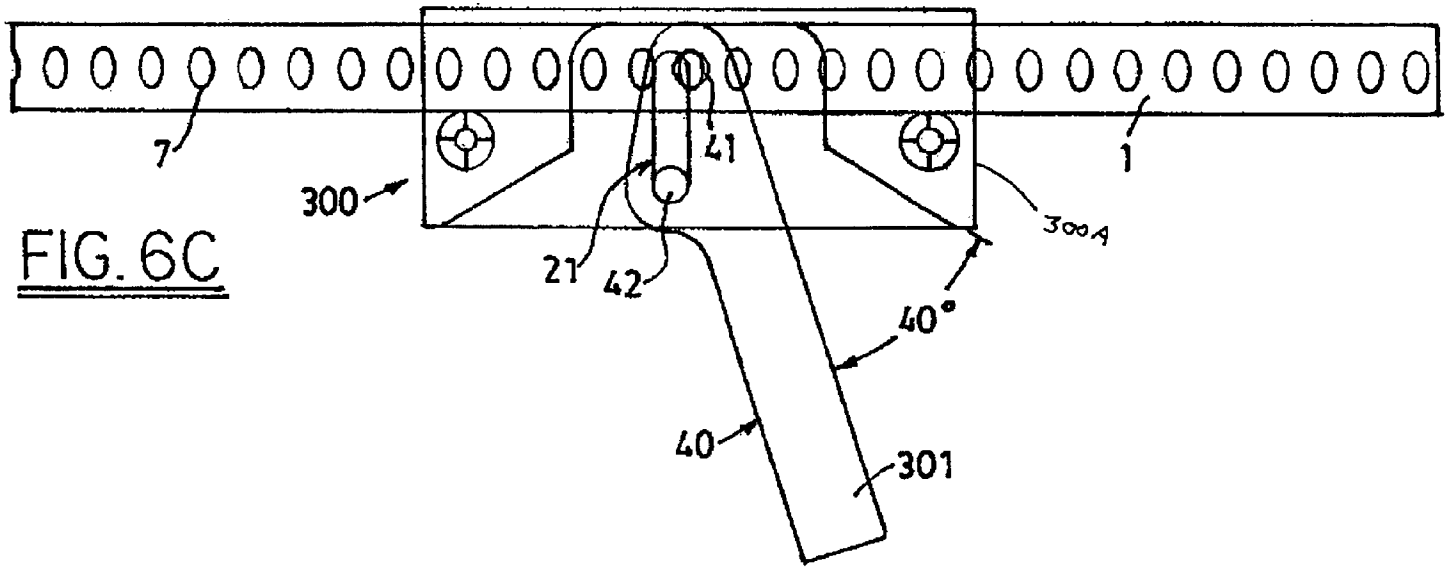
FIG. 6C provides a schematic cross-sectional view of the actuating assembly after it has been moved 40 degrees towards a closed position.
Figure 6D:
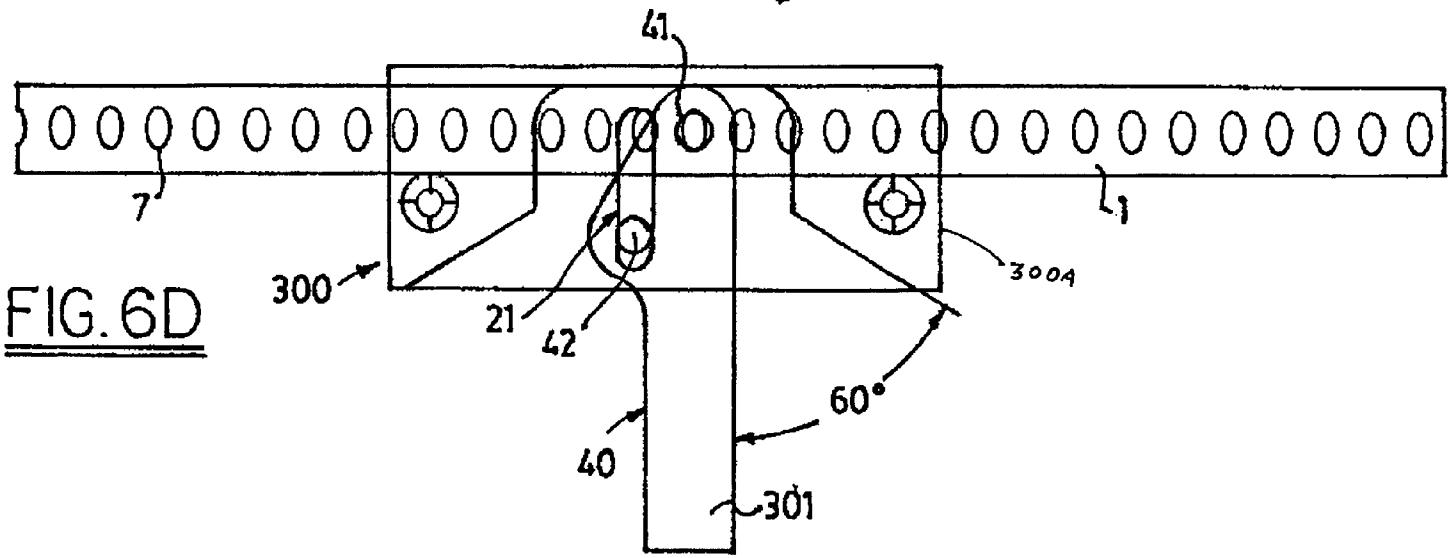
FIG. 6D provides a schematic cross-sectional view of the actuating assembly after it has been moved 60 degrees towards a closed position.
Figure 6E:
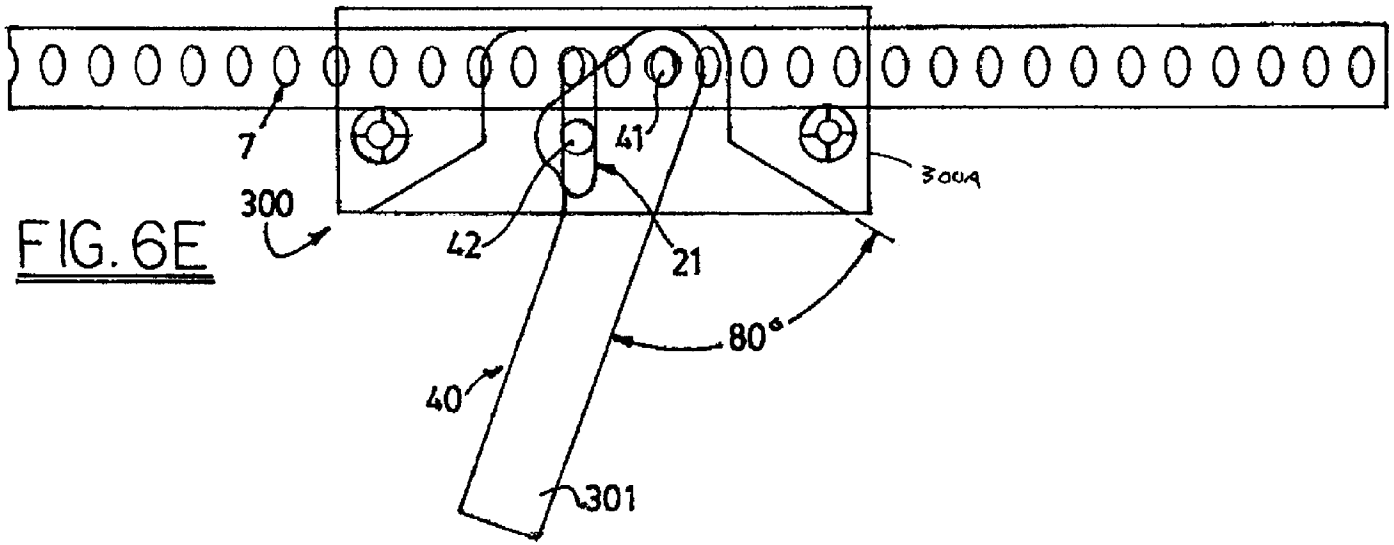
FIG. 6E provides a schematic cross-sectional view of the actuating assembly after it has been moved 80 degrees towards a closed position.
Figure 6F:
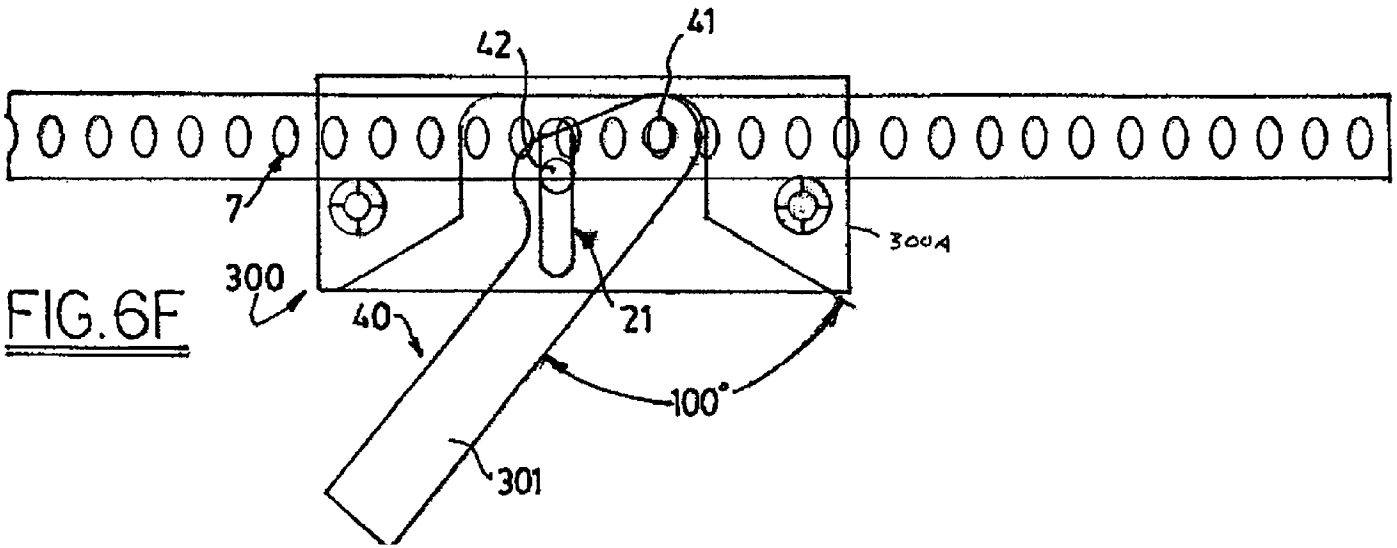
FIG. 6F provides a schematic cross-sectional view of the actuating assembly after it has been moved 100 degrees towards a closed position.
Figure 6G:
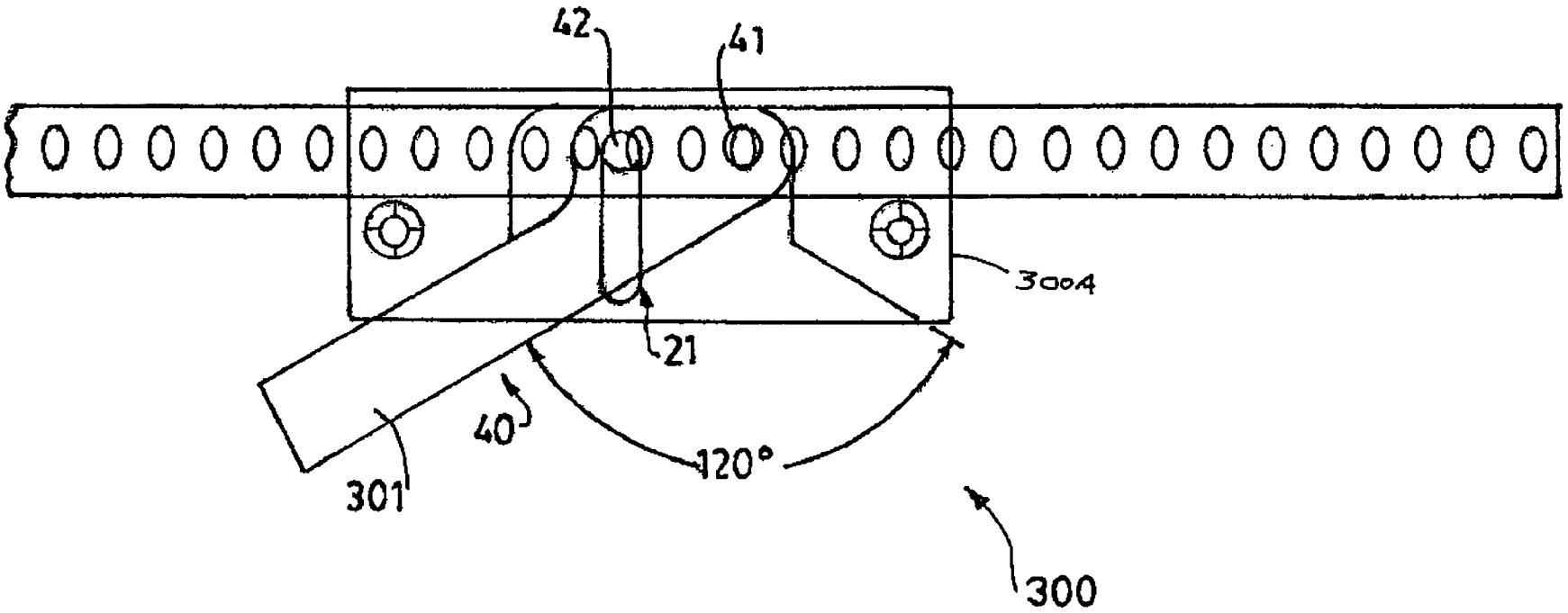

Tape 1 serves as the flexible push-pull member in our design and can start at an actuating assembly (denoted generally by arrow 300). In the embodiments of our invention illustrated in FIGS. 1 through 4B, actuating assembly 300 is mounted on a windowsill 2 or at other locations on the frame (or perimeter) of a fenestration opening. Tape 1 can extend to as many locking pin assembly locations as desired. These could be placed all the way around the perimeter of a fenestration opening (e.g.-all the way around a window or doorframe). In most cases, however, a swinging sash or door will require only the installation of an upper locking pin assembly (denoted generally by arrow 100) and a lower locking pin assembly (denoted generally by arrow 200) on frame 4 in order to ensure that the sash or door is securely fastened when closed. Thus, in the preferred embodiments illustrated in FIGS. 1 through 3, tape 1 extends around the corner of a window frame via corner bracket 3 and upward along window frame 4 to upper locking pin assembly 100 and lower locking pin assembly 200.

In our invention, both locking pin assemblies 100, 200 can be substantially identical in terms of their form and parts. Instead of having a locking pin permanently affixed to tape 1, the locking pins 5 of these embodiments have collars 5A that trap the locking pins 5 in place within guides 6 mounted on frame 4. Our locking pins 5 also have a coaxial motion transmitting pin 5B that extends into pin slots 7 in tape 1. (Only one pin slot 7 is denoted to avoid over-crowding of the drawing figures.) Collars 5A keep pins 5 trapped within guides 6 mounted to the casement side (frame 4) so that pins 5 extend outward to engage or disengage keepers 8 on the sash, when their motion transmitting pins 5B are moved up and down by tape 1.

The elimination of any permanent connection between our locking pins 5 and tape 1 greatly simplifies the installation of our invention. It also allows upper locking pin assembly 100 and lower locking pin assembly 200 with their respective locking pins 5 to be mounted to engage various pin slots 7 in tape 1. Tape 1 can be provided in rolls and can easily be trimmed to the length desired. This allows our locking pin assemblies 100, 200 to be affixed at virtually any location along frame 4.

Thus, both locking pin assemblies 100, 200 and actuating assembly 300 can be easily and simply positioned by the installer in any location desired or at any location dictated by the dimensional requirements of the fenestration opening. Some may choose to mount the actuating assembly 300 between locking pin assemblies 100, 200 on frame 4. Ultimately, all a user needs for adding the fenestration locking system of our invention to almost any window or door in almost any configuration is: (1) a strip of perforated tape 1; (2) pins 5 for the keepers 8 on the window sash or door; (3) pin guides 6 for frame 4; (4) a corner bracket 3 for guiding the tape 1 at the corner of the window or door frame; (5) keepers 8 for the sash or door; and (6) some type of actuating member to move tape 1. The foregoing components can be advantageously manufactured from a variety of materials, including plastics and metallic materials.

The preferred actuating member for our invention is actuating assembly 300, which can be best understood by reviewing FIGS. 5A through 7C. Locking lever assembly 300 includes a housing 300A formed from an upper piece 20 with a transverse slot 21 that is transverse to and above locking tape 1 and a lower piece 30 with a parallel slot 31 oriented in the direction of movement of the locking tape 1. A locking lever 40 of our actuating assembly 300 has a handle 301 and a drive pin 41 opposite the handle 301 that extends downward through parallel slot 31 into one of the pin slots 7 of tape 1. Pivot pin 42 of locking lever 40 is offset towards handle 301 and extends upwards into the transverse slot 21 perpendicular to tape 1. The lever 40 is rotated, pivoting around drive pin 41 and pivot pin 42, as it is moved to its locked position. In this process, pivot pin 42 moves first to one end of transverse slot 21 (see, FIG. 6A) and then reverses direction and moves to the other end of transverse slot 21. (See, FIGS. 6B-6G.) Meanwhile, tape drive pin 41 is pushed along in the direction of movement of tape 1. As FIGS. 6B and 6C make clear, transverse slot 21 must be at least equal to the distance between drive pin 41 and pivot pin 42.

This arrangement provides a low mechanical advantage and higher speed movement as the locking motion is commenced and a greatly increased mechanical advantage and slower speed movement as the locking pins 5 are driven home to pull a sash or door snuggly against its frame. The arrangement also aligns the drive pin 41 and the pivot pin 42 with the direction of movement of tape 1 when the sash is locked. In this position, it is not possible to pry into the edge of the window or door and push against locking pin(s) 5 or drive pin 41 and move tape 1 to an unlocked position.

Figure 7A:
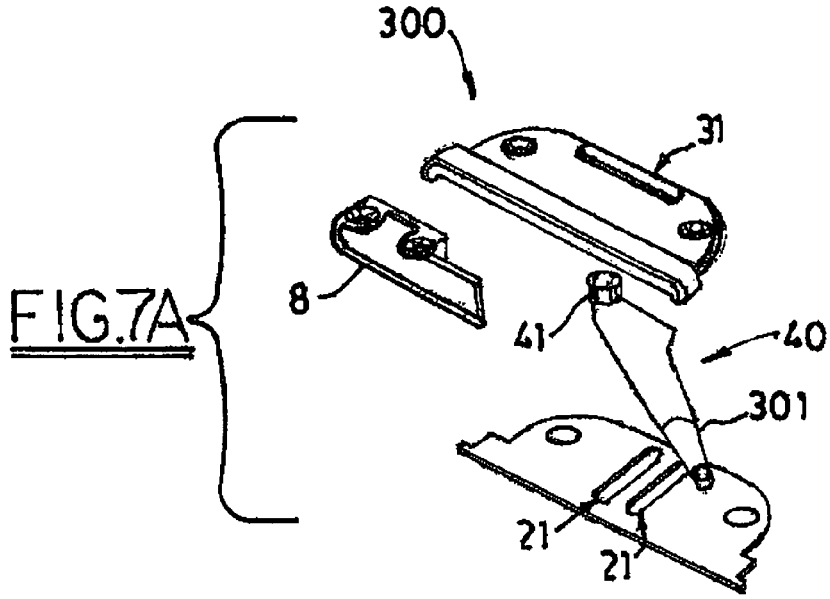
Figure 7B:
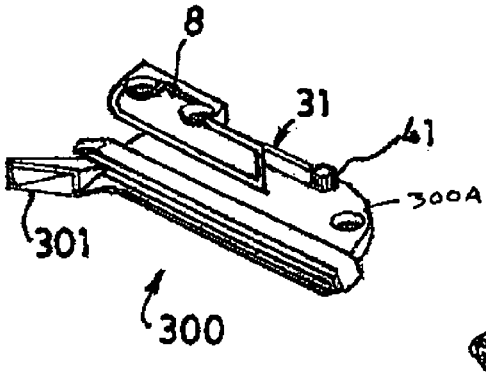
Figure 7C:
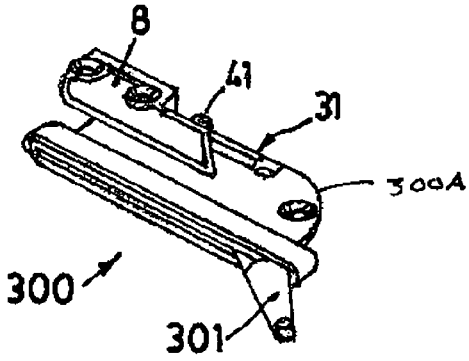
Figure 7D:
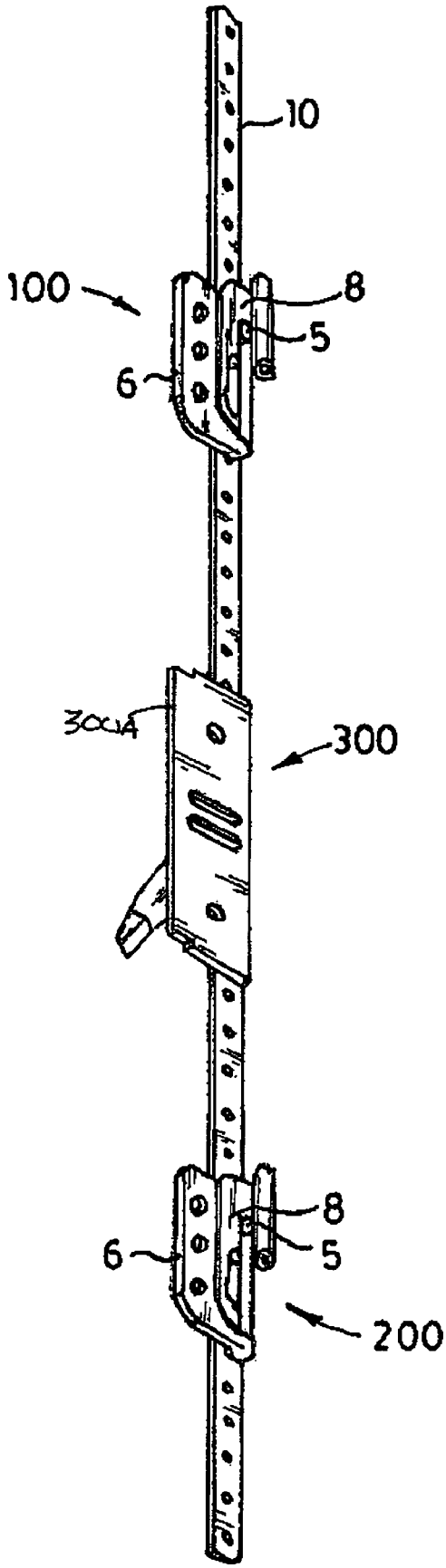
FIG. 7D illustrates an actuating assembly used to drive a rigid lock bar.

As illustrated in FIGS. 7A, 7B, and 7C, our unique actuating assembly 300 can also be used by itself without tape 1 as part of a fenestration locking system. In this situation, the orientation of our actuating assembly 300 is reversed so that drive pin 41 projects outward. Drive pin 41 interfaces not with tape 1, but directly with keeper 8. As will be noted, the preferred embodiment illustrated also has two transverse slots 21. This allows the use of locking levers 40 adapted to open in either direction by using the transverse slot 21 suited to that locking lever 40. Alternatively, as illustrated in FIG. 7D, an actuating assembly 300 assembled in the usual manner could be used to drive the type of rigid lock bar 10 typical in sash locking assemblies used with a swinging sash. In this circumstance, it could advantageously be mounted at the side of an enclosure between locking pin assemblies 100, 200.

In the embodiments of our invention illustrated in FIGS. 8A through 10B, the actuating assembly (not shown) is mounted on a swinging sash or door mounted in a fenestration opening. The keeper (not shown) would be incorporated into the frame for the swinging sash or door. Modified tape 1A can extend to as many locking pin assembly locations around the perimeter of a swinging sash or door as desired. However, as was the case with the prior embodiments described, a swinging sash or door will usually require only the installation of an upper locking pin assembly (not shown) and a lower locking pin assembly (not shown) in order to ensure that the sash or door is securely fastened when closed.

Modified tape 1A of these embodiments is seated in a groove 400 in the edge of a door/sash 401. It extends around the corner of door/sash 401 and is held in place in the curved portion of groove 400 extending around the corner of door/sash 401 via a corner guide/cover 402. In general, however, modified tape 1A is held in place by cover strips 403. Cover strips 403 and modified tape 1A have specialized features to enable them to perform as required in this embodiment. First, the structure and positioning of cover strips 403 requires the use of fastening means positioned in a way that could, potentially, interfere with the function of modified tape 1A. The centrally positioned screw holes 403A of cover strips 403 require the placement of tape slots 1B in modified tape 1A in order to allow modified tape 1A to slide back and forth around screws fastening cover strips 403 to a door/sash 401 via screw holes 403A. Second, cover strips 403 serve the same general function as the guides 6 of the first embodiment. Thus, they must also be provided with slide slots 6A to allow pins 5 to be moved up and down by modified tape 1A. The keeper (not shown) for this embodiment will typically be incorporated into the frame for the fenestration opening with a gap in the frame allowing the locking pin 5 to be released and the sash or door to be unlocked.

Figures 8A, 8B:
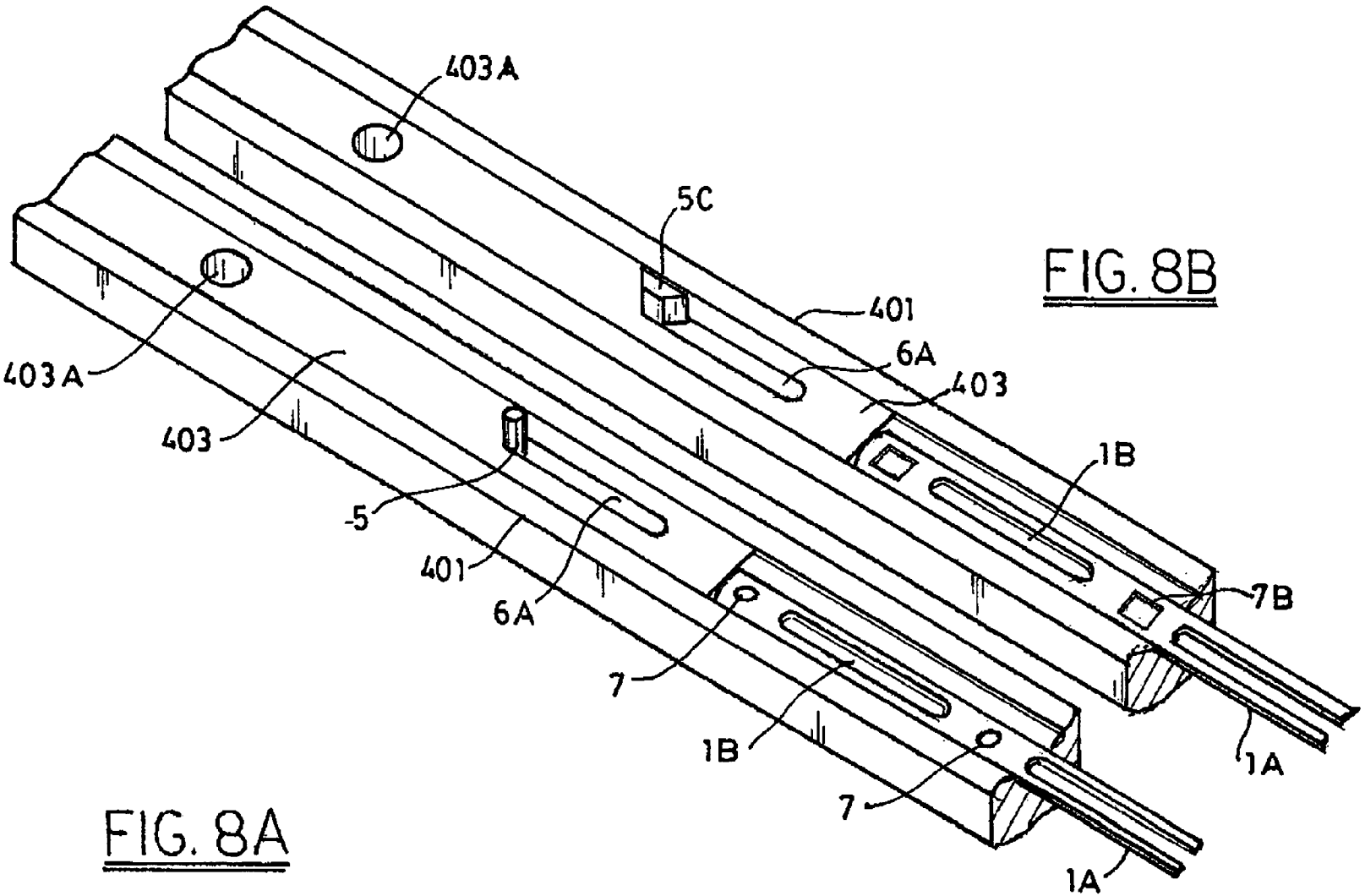
Figure 9B:
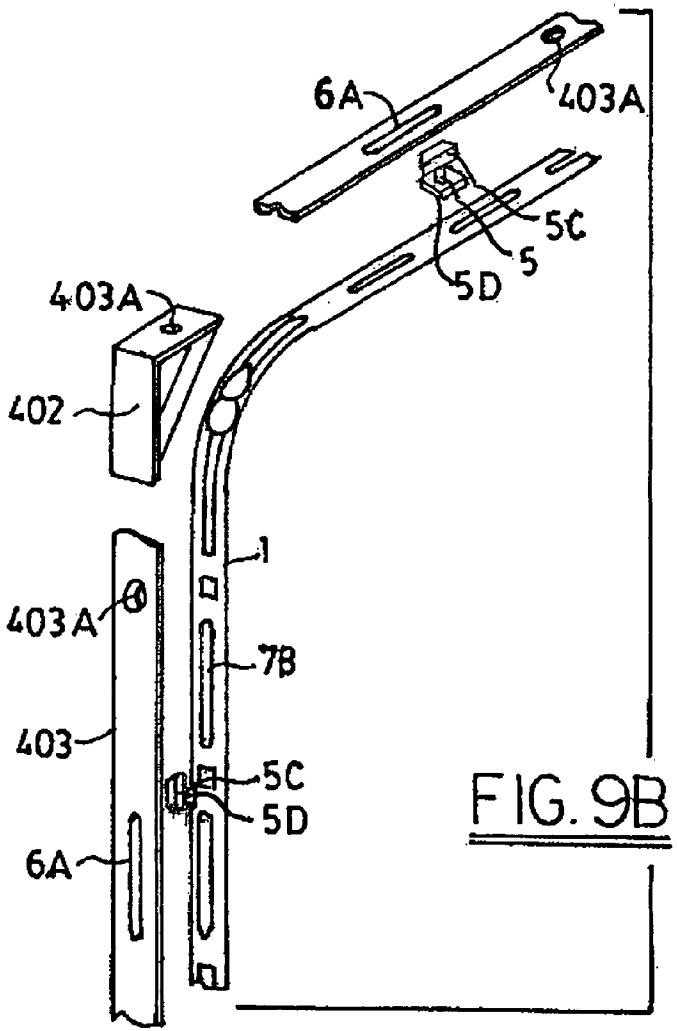
FIG. 9B provides an exploded view illustrating some of the elements extant in FIG. 9A.
Figure 9A:
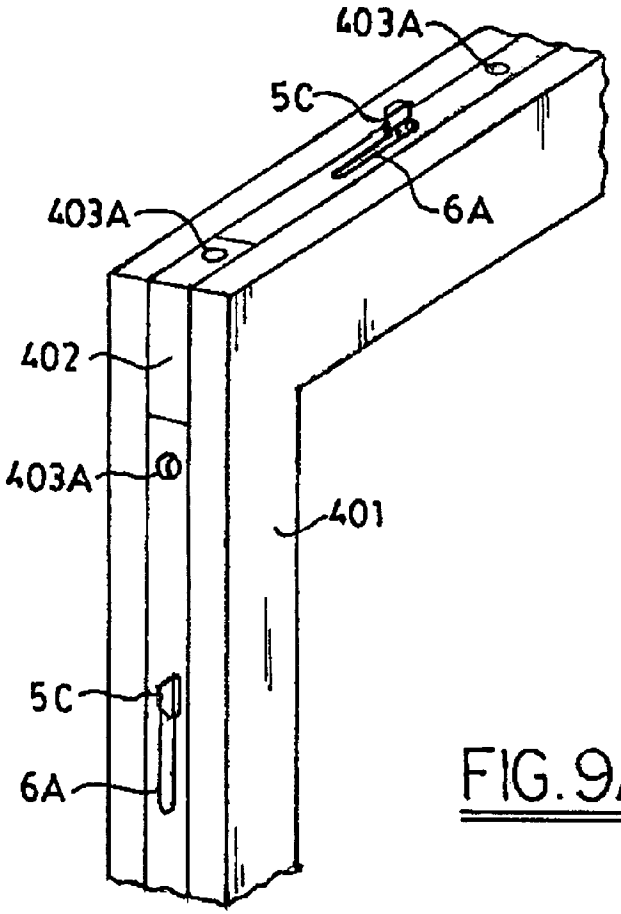
FIG. 9A provides a perspective view of the embodiment illustrated in FIG. 8B mounted at the corner of a fenestration closure means.

FIGS. 8B and 9B also illustrate a variation of our invention having an enlarged wedge-shaped locking pin head 5C and an enlarged square coaxial motion transmitting pin 5D. (Wedge-shaped heads provide a mechanical advantage to the user when the head and the keeper are not completely aligned.) Square motion transmitting pin 5D fits into a square slot 7B in modified tape 1A. In this embodiment, pin 5 is fitted to slide slot 6A and is narrower than square motion transmitting pin 5D. (Thus, square motion transmitting pin 5D instead of a collar 5A serves to maintain the position of pin 5 under cover strip 403.)

Figure 10B:
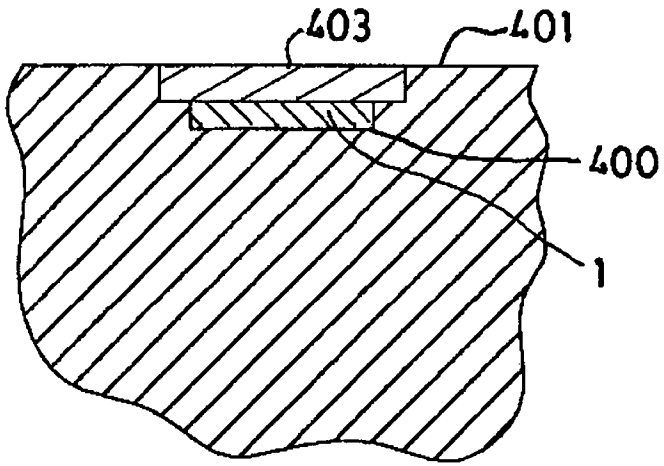
Figure 10A:
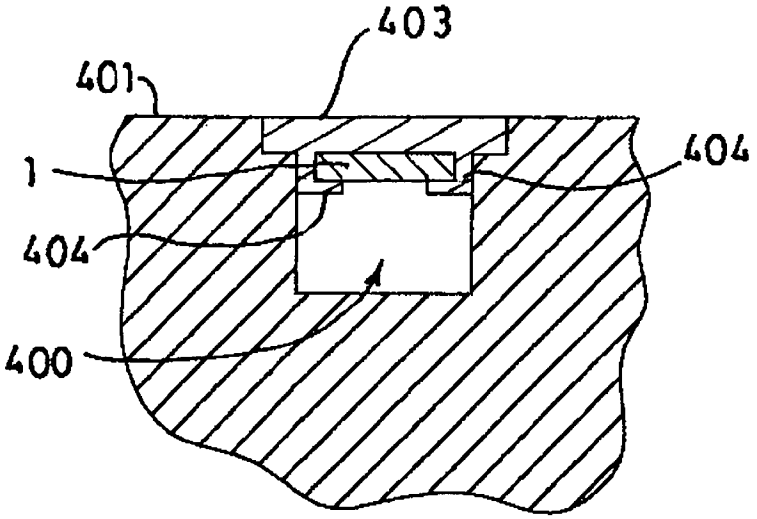
FIG. 10A provides a cross-sectional view of a first embodiment of the cover strip of our invention.
Figure 13A:
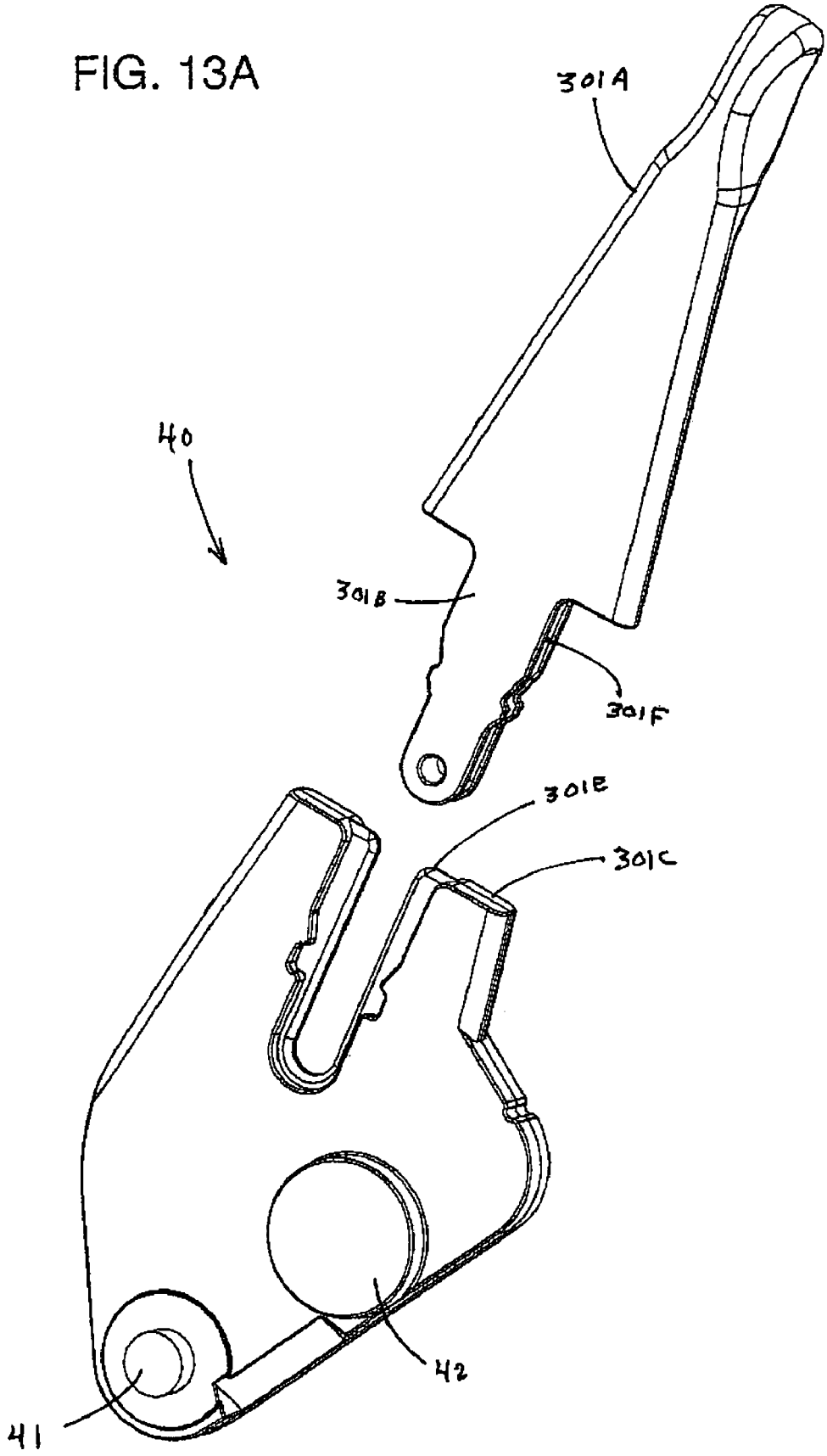
FIG. 13A provides a perspective disassembled view of a two-part locking lever with a separable snap-in handle. The locking pin and drive pin of this embodiment are located on the same sides of the locking lever.
Figures 13B, 13C:
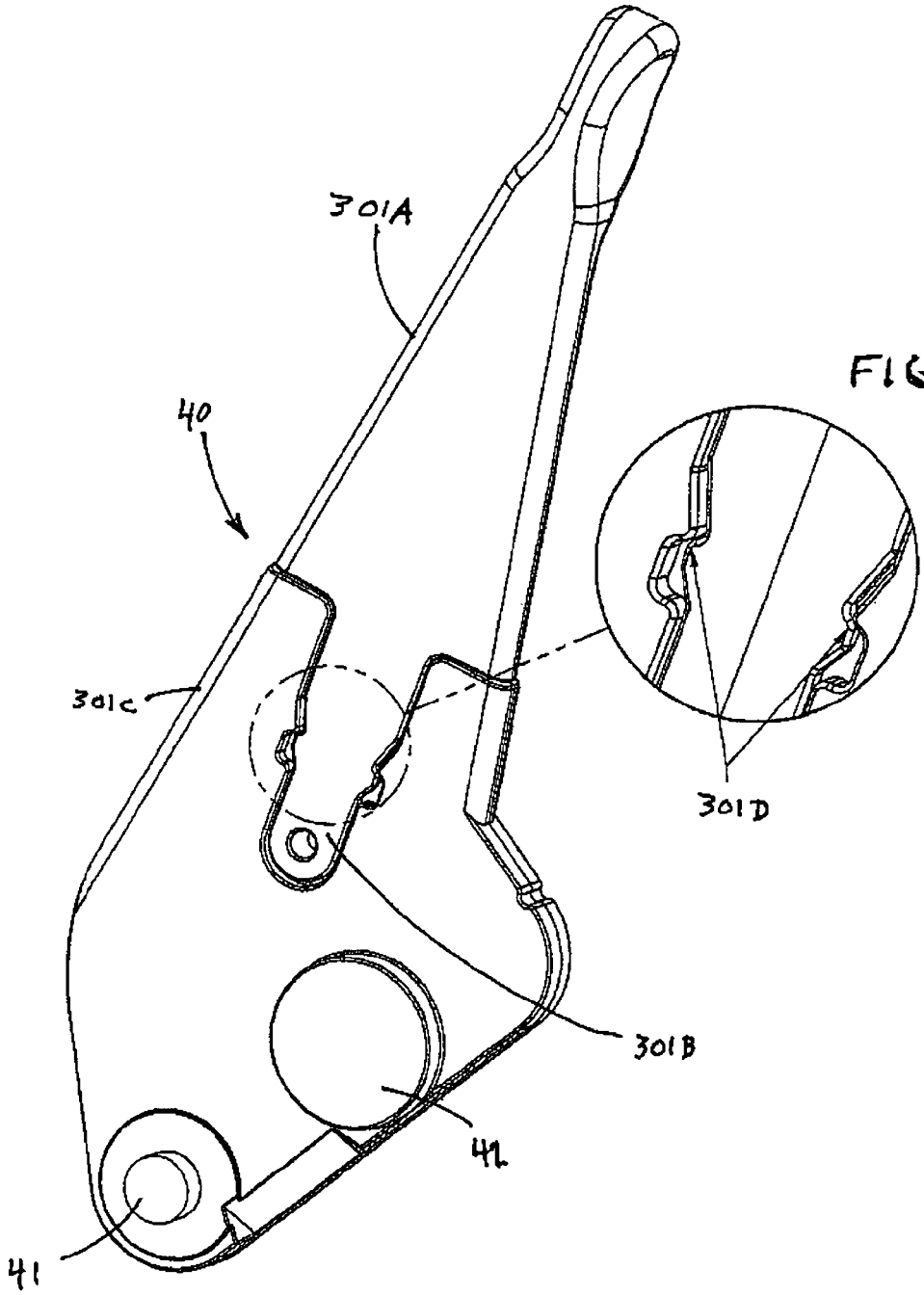
FIG. 13B provides a perspective assembled view of the two-part locking lever with separable snap-in handle illustrated in FIG. 13A.
FIG. 13C provides a perspective detailed view of the snaps used to hold the separable snap-in handle of FIGS. 13A and 13B in position.

In addition, FIGS. 10A and 10B illustrate two variations of cover strip 403. In the variation illustrated in FIG. 10A, modified tape 1A rests in a slot under cover strip 403 created by "L"-shaped extensions 404. This variation is suitable for placement in existing grooves 400 that may be too large to easily serve the purposes of this invention. Another variation is illustrated in FIG. 10B. In this variation, cover strip 403 is formed for placement over a groove 400 that is more closely tailored for the purposes of this invention; thus, extensions 404 are unnecessary.

Other possible variations in our invention are illustrated in FIGS. 11A through 17D. FIGS. 11A and 11B illustrate an embodiment with a pin 5 having a more elongate wedge-shaped head 5D and a rectangular collar 5A, while FIGS. 12A and 12B illustrate an embodiment having a hook-shaped head 5E with two tabs 50 by which head 5E interacts with tape 1. As the "pin" (hook-shaped head 5E) for this embodiment is shaped like a "keeper", the keepers for this embodiment can advantageously be pin-or wedge-shaped. This embodiment uses a side screw guide 51 that can be pressed down onto and fastened directly above the hook-shaped head 5E so as to hold hook-shaped head 5E in position. The embodiment illustrated uses screws that are placed into screw holes 52 that penetrate the side of a frame or structure on which this embodiment is mounted rather than being placed through or along side of tape 1.

FIGS. 13A through 17D focus on additional possible variations in the design, construction, and placement of our actuating assembly 300. In all of these figures a two-part locking lever 40 with a separable snap-in handle 301A for use with actuating assembly 300 is illustrated. This option allows for an easily 10 removed handle for both painting and changing colors of the hardware. In order to make this possible without having an excessive number of component parts, it is preferable to form handle 301A with an extension 301B formed from a rigid material. (See, e.g., FIGS. 13A through 13C). Likewise, receiver 301C for extension 301B can be formed from a material and in a configuration that allows it to flex to receive handle 301A. Thus, receiver 301C is formed from plastic materials in a basic U-shaped configuration where the two arms of the "U" flex apart to receive rigid metal extension 301B. As will be observed, all of these parts are basically planar and lie in a lever arm plane substantially parallel to a plane defined by drive member slot 31. To better hold lever 40 and handle 301A 20 together under operational forces, a tongue-in-groove connection is provided along the generally U-shaped interface between these two parts with the tongue 301E forming part of the receiver 301C and the groove 301F forming part of extension 301B. In addition, it was found necessary (once again in order to maintain handle 301A in connection with receiver 301C under operational forces) to provide a plurality of snap connections 301D between receiver 301C and extension 301B.

Figure 14:
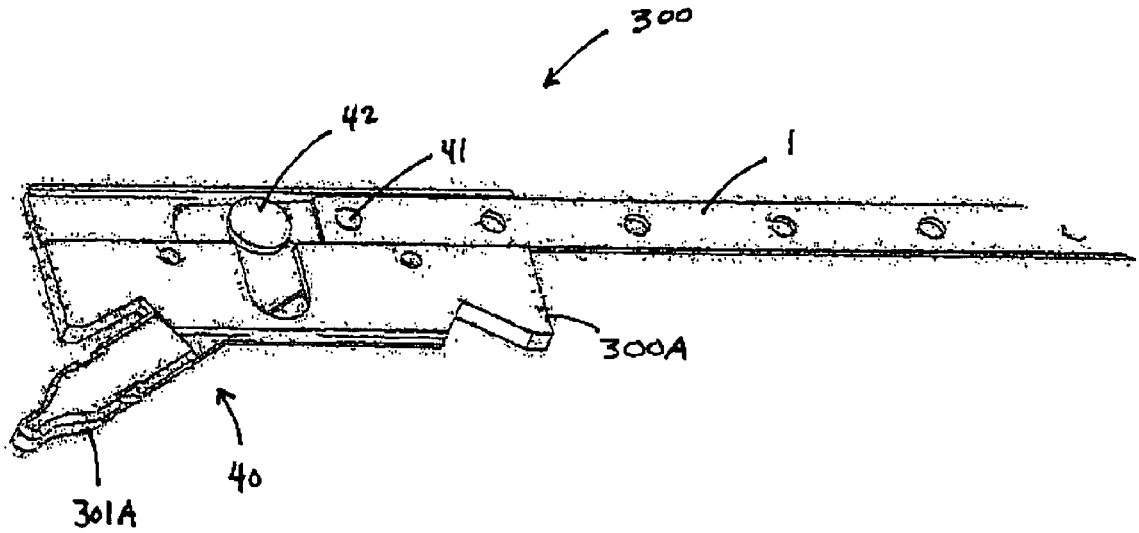
Figure 15:
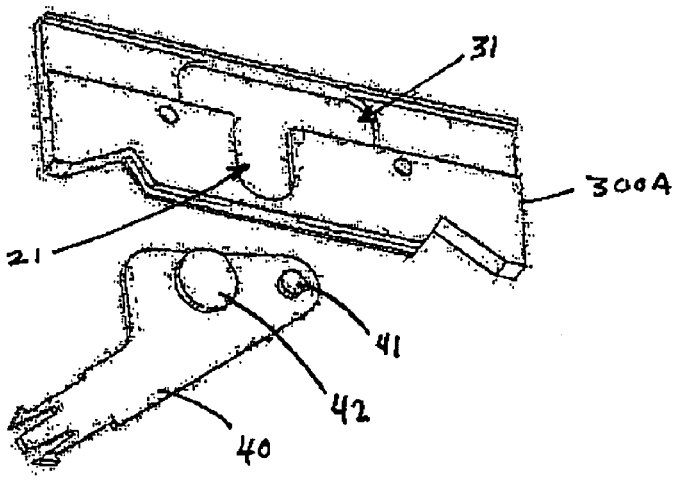

FIGS. 13A through 17D also illustrate a configuration for our actuating assembly 300 where both slots (transverse slot 21 and parallel slot 31) and both pins (drive pin 41 and pivot pin 42) are located on the same side of locking lever 40. In this configuration, as best illustrated in FIGS. 14 and 15, pivot pin 42 and transverse slot 21 are generally wider than drive pin 41 and parallel slot 31. This assures that pivot pin 42 does not enter parallel slot 31 and that all elements perform their proper function despite the fact that transverse slot 21 and parallel slot 31 intersect as well as overlap. This configuration also helps to balance the forces at work when the actuating assembly 300 is operated. With pivot pin 42 and drive pin 41 on the same side of the handle, the forces acting on pivot pin 42 and drive pin 41 align. When these forces are not aligned, a moment is created which acts on the handle 301 causing it to rotate, adding friction. This translates into additional force when activating handle 301.

Figure 16A:
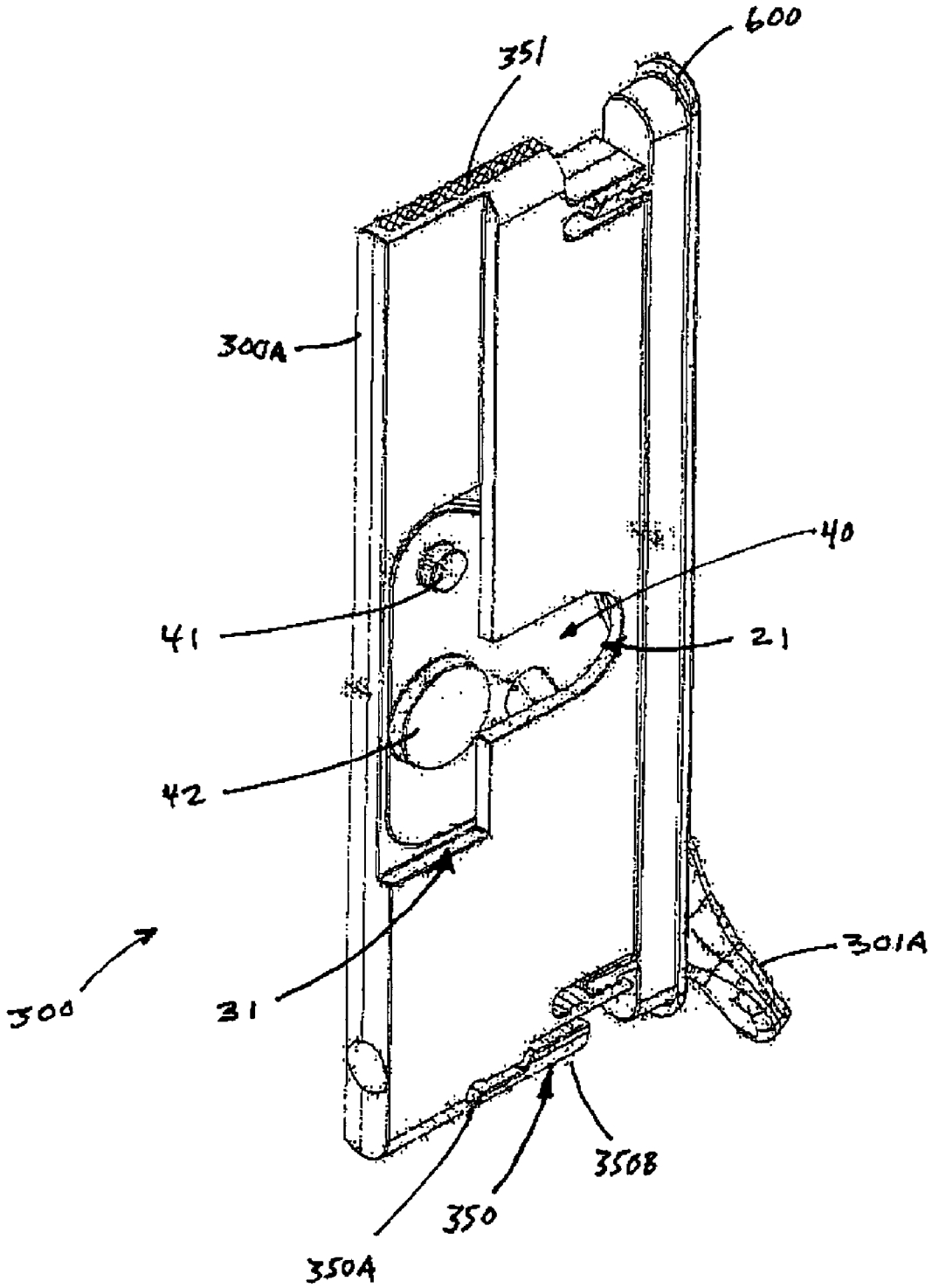
FIG. 16A provides a perspective view of an actuating assembly intended for insertion into a rout in a sash, door or frame.
Figure 16B:
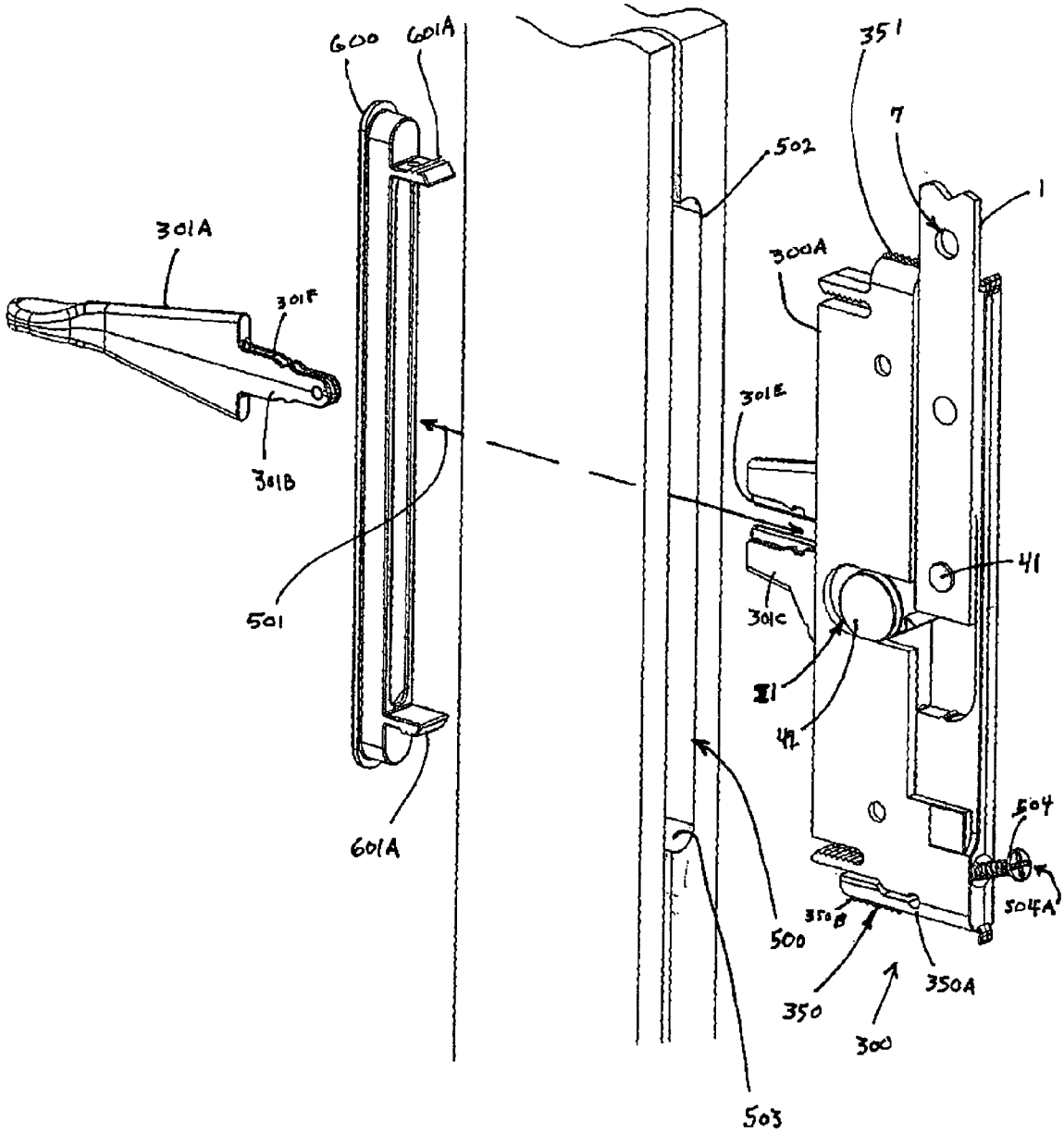
FIG. 16B provides an exploded perspective view of the assembly illustrated in FIG. 16A.

FIGS. 16A and 16B provide perspective views of an actuating assembly intended for insertion into a rout 500 in a sash, door or frame. As will be noted, actuating assembly 300 is adapted to slide along an insertion axis 501 into the rout 500 via an actuator rout opening 502, which rout 500 and actuator rout opening 502 are in one of a fenestration frame and a door or sash mounted in that frame. (Insertion axis 501 is generally parallel to planes in which lever arm 40 rotates and, likewise, in which transverse slot 21 and parallel slot 31 are located.) A retention member 350 forms part of actuating assembly 300. Retention member 350 is also adapted to slide along insertion axis 501 into rout 500 via the actuator rout opening 502. However, in addition to this, retention member 350 is adapted for movement transverse to the insertion axis whereby it can contact an interior side 503 of rout 500. A tightening member (screw 504) is used to move retention member 350 transverse to insertion axis 501 so that it contacts and presses against side 503 and thereby resists removal of the actuating assembly 300 from rout 500. An opposing gripping portion 351 is located opposite retention member 350 such that transverse movement of retention member 350 also forces opposing gripping portion 351 against an opposing side of rout 500 so as to further resist removal of actuating assembly 300 from rout 500.

In the preferred embodiments illustrated, retention member 350 is elongate with a first end 350A by which it is connected to actuating assembly 300 and a contact end 350B which contacts interior side 503. Preferably, retention member 350 is molded and formed as an integral portion of actuating assembly 300. Further, it should be noted that this system is completely different than current systems, which use overhanging flanges with screws fastening directly into the fenestration frame. Instead of using an overhanging flange with a screw boring into the fenestration frame outside of the borders of rout 500, our tightening system is arranged so that screw 504, its interface (screw head 504A), retention member 350 and gripping portion 351 are all located within the boundary defined by rout 500 and actuator rout opening 502.

As will also be noted, rout 500 penetrates completely through the fenestration frame 4 (or door/sash mounted in that frame) so that there is a handle rout opening opposite actuator rout opening 502. Handle 301A extends through the handle rout opening. Thus, while actuating assembly 300 is mounted in rout 500 by sliding it into actuator rout opening 502, handle 301A will typically be attached to receiver 301C of lever arm 40 by inserting it through a slotted escutcheon 600 (with snap connectors 601A for connecting it to actuating assembly 300) that serves to cover the handle rout opening.

Figure 17A:
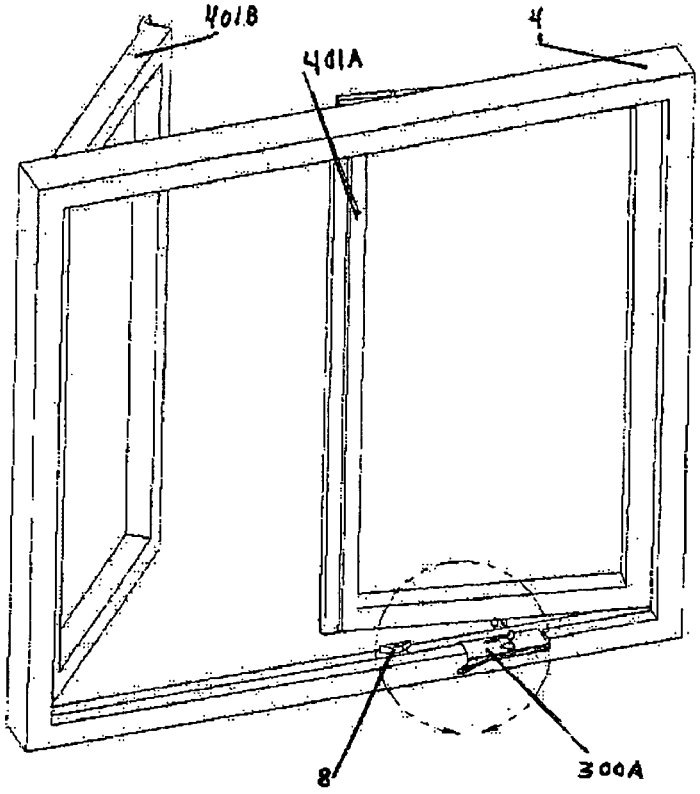
FIG. 17A provides a perspective view of an embodiment of this invention installed in a French Casement Window with sashes open.
Figure 17B:
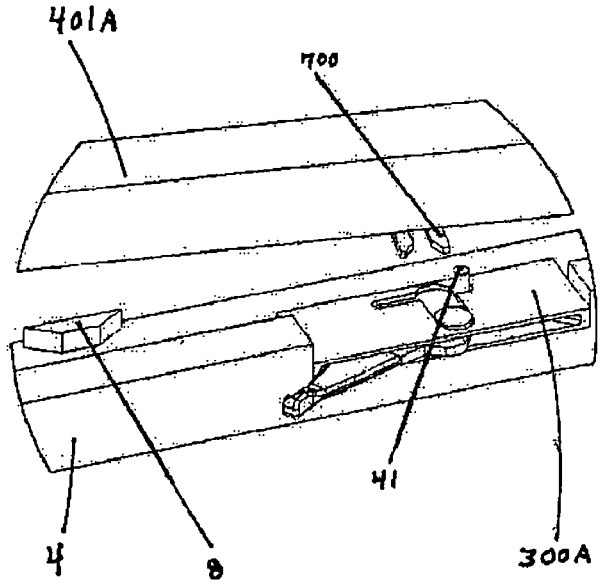
FIG. 17B provides a more detailed perspective view of the actuating assembly of FIG. 17A.
Figure 17C:
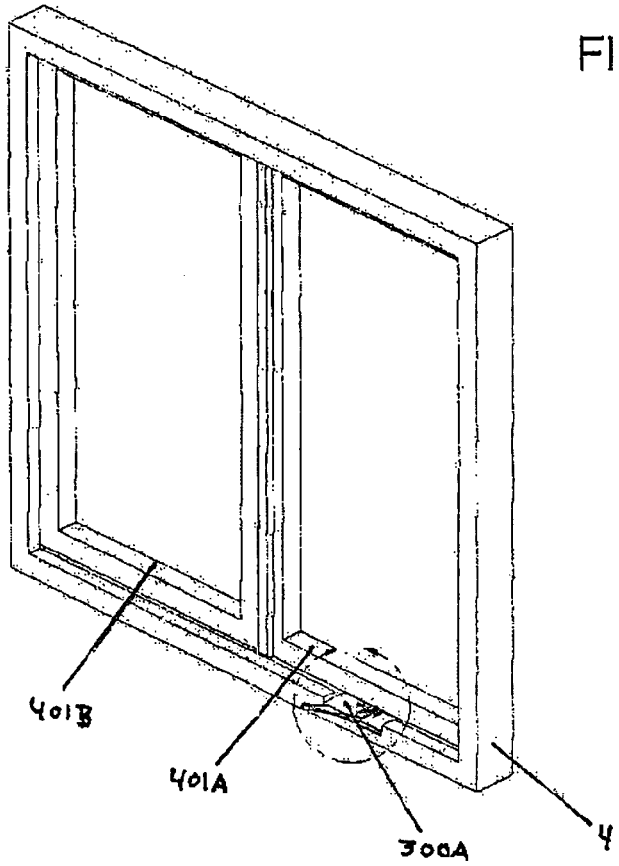
FIG. 17C provides a perspective view of the embodiment shown in FIG. 17A with the sashes closed.
Figure 17D:
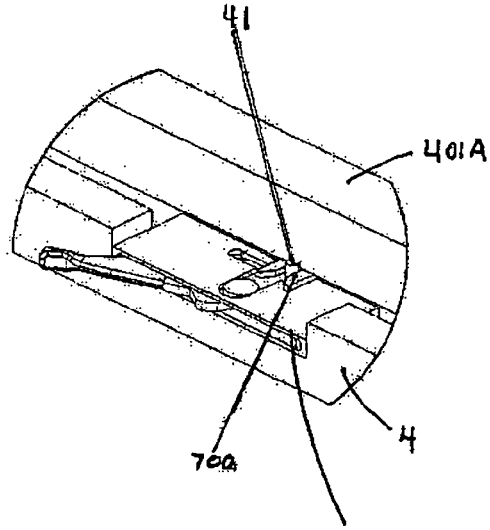

Finally, FIGS. 17A through 17D provide perspective views of an embodiment of our invention installed in a French casement window. In a French casement window, sashes 401A, 401B may need to be fastened to each other as well as to the frame 4 for the window. Thus, a situation is illustrated where an actuating assembly 300A mounted to frame 4 has an extended drive pin 41 that interfaces with a connector 700 attached to a tape (not shown) in tape mounted window sash 401A. In this situation, the tape is provided with locking pins (not shown) that interact with keepers 8 located on the window frame 4 and an opposing sash 401B to hold the two window sashes in a closed and locked position as illustrated in FIGS. 17C and 17D.

The foregoing variations and embodiments should not, however, be seen as exhaustive. The inventive concepts underlying our invention can give rise to numerous variations without exceeding the scope of our invention as better defined by the claims that follow.

We claim:

1. An actuator assembly for use in a fenestration system, the fenestration system having a frame for a window sash or door, comprising:

a housing;

a lever arm attached to said housing moveable with respect to said housing between a first lever arm position and a second lever arm position;

said lever arm is rotatable about two axes of rotation, one axis consisting of a drive member axis and a second axis consisting of a pivot member axis, said axes being substantially perpendicular to each other;

said lever arm having a handle portion to move the lever arm, a drive member and a pivot member;

said drive member being slidable in a drive member slot along the drive member axis in said housing between a first drive member position and a second drive member position;

said pivot member being slideable within a pivot member slot along the pivot member slot in said housing;

said pivot member being wider than the drive member to assure that the pivot member does not enter and move in the drive member slot;

an engageable member engaged to the drive member, said engageable member comprising at least one locking pin that engages a corresponding at least one keeper on the frame to maintain the frame and the window and the window sash or door engaged;

wherein, when the lever arm is moved from the first lever arm position toward the second lever arm position, it will make the pivot member slide within the pivot member slot to allow the lever arm to rotate;

wherein, when the lever arm is rotated, the drive member will move from the first drive member position toward the second member position so as to move the engageable member in order to disengage the engagement of the at least one locking pin from their respective at least one keeper to allow the window sash or door to move away from the frame.

2. The actuator assembly of claim 1 wherein said lever arm has more than one side and said pivot member and said drive member are both located on the same side of said lever arm.

3. The actuator assembly of claim 1 wherein said lever arm has more than one side and said pivot member and said drive member are located on opposite sides of said lever arm.

4. The actuator assembly of claim 1 wherein said drive member can cause said engageable member to move due the engagement of said engageable member via an intermediate linking member which links said drive member to said engageable member.

5. The actuator assembly of claim 1 wherein said pivot member is aligned with said drive member slot when the actuating assembly is locked.

6. The actuator assembly of claim 1 wherein said pivot member slot and said drive member slot overlap.

7. The actuator assembly of claim 1 wherein said handle portion of said lever arm is detachable.

8. The actuator assembly of claim 7 wherein said lever arm has a rigid extension that connects to a flexible receiver, which flexible receiver flexes to allow said lever arm to connect to said flexible receiver by a tongue-in-groove connection.

9. The actuator assembly of claim 8 wherein said lever arm and said rigid extension are substantially planar and lie in a lever arm plane substantially parallel to a plane defined by the drive member slot.

10. The actuator assembly of claim 8 wherein said tongue forms part of the flexible receiver and said groove forms part of the rigid extension.

11. The actuator assembly of claim 1 wherein said actuating assembly is mounted by being inset into the fenestration frame.

12. The actuator assembly of claim 1 further comprising an opposing gripping portion located on a side of said actuating assembly opposite said retention member such that transverse movement of said retention member urges said opposing gripping portion against an opposing side of a rout in the fenestration frame which thereby causes said gripping portion to resist removal of the actuating assembly from the rout.

13. The actuator assembly of claim 1 wherein said engageable member is a linear member with multiple engagement sites along its length, said drive member slot is parallel to said linear member, and said drive member can engage said linear member causing said linear member to move with respect to the actuating assembly.

14. The actuator assembly of claim 13 wherein said engagement sites are perforations in said linear member.

15. The actuator assembly of claim 14 wherein said drive member inserts into at least one of said perforations.

16. The actuator assembly of claim 13 wherein said linear member is flexible.

17. The actuator assembly of claim 13 wherein said linear member is rigid.

* * * * *